US008755712B2

(12) United States Patent
Funada et al.

(10) Patent No.: US 8,755,712 B2
(45) Date of Patent: Jun. 17, 2014

(54) DEVELOPING DEVICE AND IMAGE FORMING APPARATUS USING THE SAME

(75) Inventors: Atsushi Funada, Kanagawa (JP); Keisuke Kubo, Kanagawa (JP); Ryuji Hattori, Kanagawa (JP); Keisuke Uchiyama, Kanagawa (JP); Makoto Hirota, Kanagawa (JP); Masanori Kato, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 51 days.

(21) Appl. No.: 13/616,202

(22) Filed: Sep. 14, 2012

(65) Prior Publication Data

US 2013/0195501 A1 Aug. 1, 2013

(30) Foreign Application Priority Data

Jan. 31, 2012 (JP) ..... 2012-018204
Mar. 7, 2012 (JP) ..... 2012-050521

(51) Int. Cl.
*G03G 15/08* (2006.01)

(52) U.S. Cl.
USPC ..... 399/103; 399/226; 399/269

(58) Field of Classification Search
USPC ..... 399/103, 104, 226, 229, 267, 269, 277
See application file for complete search history.

(56) References Cited

U.S. PATENT DOCUMENTS 6,813,462 B2 * 11/2004 Mitsuya et al. ..... 399/269
8,543,041 B2 * 9/2013 Nose et al. ..... 399/267

FOREIGN PATENT DOCUMENTS

JP 4-355481 A 12/1992
JP 2002-268373 A 9/2002

* cited by examiner

*Primary Examiner* — Hoang Ngo
(74) *Attorney, Agent, or Firm* — Sughrue Mion, PLLC

(57) ABSTRACT

A developing device includes: a first developing body that develops a developing agent image on a development surface using a developing agent; a second developing body that develops a developing agent image on the development surface using the developing agent; and a sealing member that is disposed between a region where a first delivery pole and a second delivery pole are opposed to each other and the development surface, and adjacently to the first developing body and the second developing body at distances so small that developing agents formed as magnetic brushes on a first conveyance pole and a second conveyance pole respectively can touch the sealing member to secure sealing to prevent the developing agent from leaking to the outside of a device body.

10 Claims, 22 Drawing Sheets

SEAL ROLL SR APPROACHES PHOTOCONDUCTOR DRUM 220 WITH THE INCREASE OF GAP BETWEEN SEAL ROLL SR AND DEVELOPING ROLL 43b

DEVELOPING DEVICE AND IMAGE FORMING APPARATUS USING THE SAME

CROSS-REFERENCE TO RELATED APPLICATIONS

This application is based on and claims priority under 35 USC 119 from Japanese Patent Application Nos. 2012-018204 filed on Jan. 31, 2012 and 2012-050521 filed on Mar. 7, 2012.

BACKGROUND

1. Technical Field

The present invention relates to a developing device and an image forming apparatus using the same.

2. Related Art

Electrophotographic image forming apparatuses often use a dual-component developing agent in which toner and magnetic carrier are mixed, or a magnetic monocomponent developing agent having magnetic toner as its primary component. The developing agent is conveyed from a developing agent reservoir portion of a developing device to a developing roll by a conveyance member. The developing agent magnetically adsorbed on the circumferential surface of the developing roll is conveyed to a position (a developing nip portion where a developing pole of the developing roll is located) opposed to a photoconductor drum, and transferred to the photoconductor drum. Thus, an electrostatic latent image formed on the photoconductor drum is developed.

Here, of developing devices, there is a two-stage type developing device in which developing rolls are provided above and below in two stages so as to ensure development in order to cope with the increasing speed of an image forming apparatus.

SUMMARY

According to an aspect of the invention, a developing device includes: a first developing body that is disposed in a device body and develops a developing agent image on a development surface using a developing agent; a second developing body that is disposed in an upper stage of the first developing body in the device body and develops a developing agent image on the development surface using the developing agent; a first developing pole that is formed as a magnetic pole for performing development in the first developing body; a first delivery pole that is formed in a position opposed to the second developing body in the first developing body and formed as a magnetic pole for performing delivery of the developing agent between the first developing body and the second developing body; a first conveyance pole that is formed between the first developing pole and the first delivery pole in the first developing body and formed as a magnetic pole for conveying the developing agent from the first delivery pole to the first developing pole; a second developing pole that is formed as a magnetic pole for performing development in the second developing body; a second delivery pole that is formed in a position opposed to the first developing body in the second developing body and formed as a magnetic pole for performing delivery of the developing agent between the first developing body and the second developing body; a second conveyance pole that is formed between the second developing pole and the second delivery pole in the second developing body and formed as a magnetic pole for conveying the developing agent from the second delivery pole to the second developing pole; and a sealing member that is disposed between a region where the first delivery pole and the second delivery pole are opposed to each other and the development surface, and adjacently to the first developing body and the second developing body at distances so small that developing agents formed as magnetic brushes on the first conveyance pole and the second conveyance pole respectively can touch the sealing member to secure sealing to prevent the developing agent from leaking to the outside of the device body.

BRIEF DESCRIPTION OF THE DRAWINGS

Exemplary embodiment(s) of the present invention will be described in detail based on the following figures, wherein.

DETAILED DESCRIPTION

First Exemplary Embodiment

Figure 1:
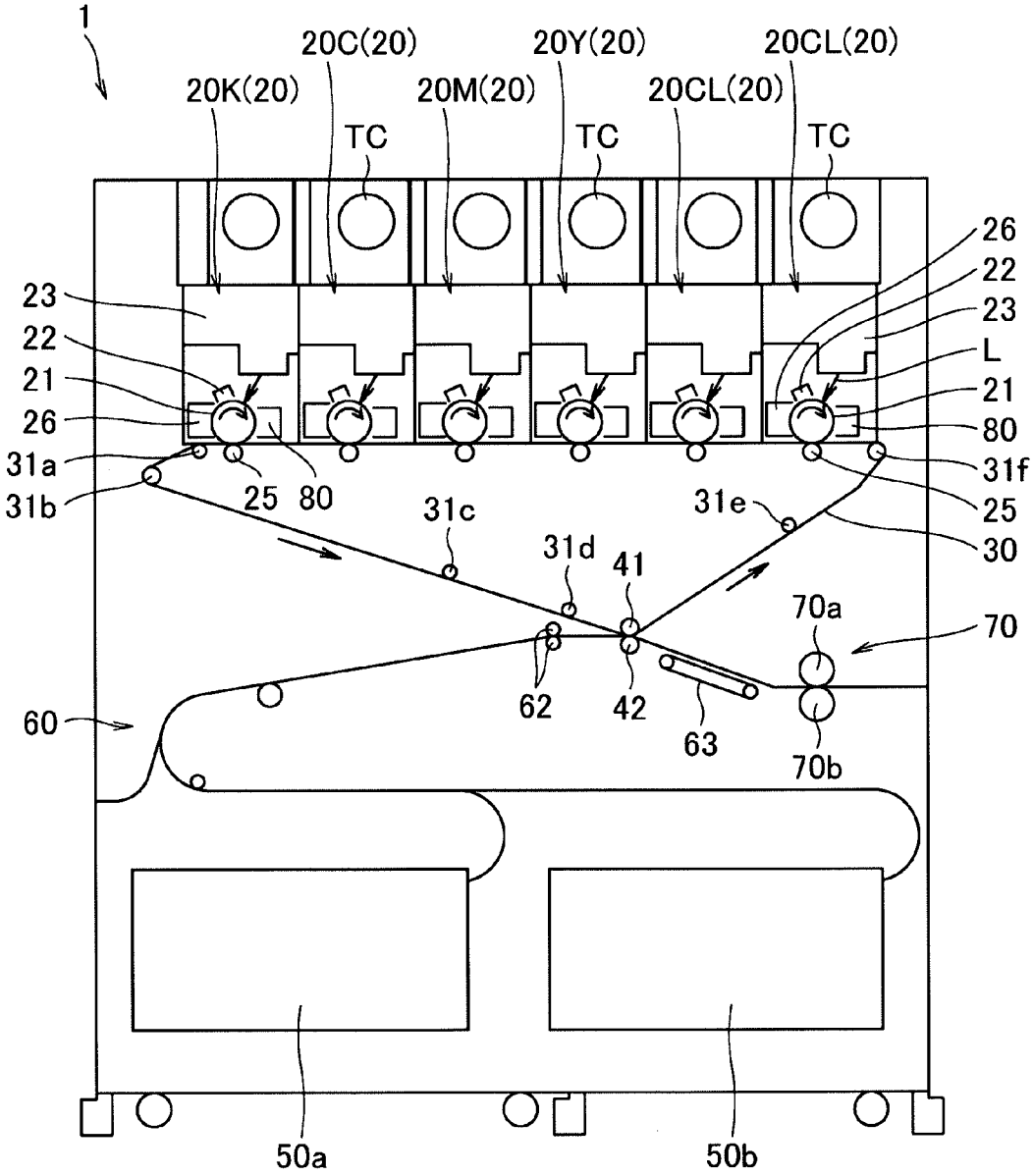
FIG. 1 is a conceptual view of an example of an image forming apparatus according to a first exemplary embodiment of the invention.

A first exemplary embodiment as an example of the invention will be described in detail below with reference to the drawings. In the drawings for explaining the embodiment, the same constituent members are referred to by the same numerals correspondingly by principle, so that redundant description thereof will be omitted.

FIG. 1 is a conceptual view of an example of an image forming apparatus according to the first exemplary embodiment of the invention.

An image forming apparatus 1 according to the embodiment is, for example, a tandem type color printer, which is provided with a plurality of imaging units 20, an intermediate transfer belt (an example of an object to which toner images will be transferred) 30, a pair of a backup roll 41 and a secondary transfer roll 42, paper feed trays 50*a* and 50*b*, a paper conveyance system 60 and a fixing unit 70.

The imaging units 20 include, for example, four color imaging units 20Y, 20M, 20C and 20K for forming toner images of respective colors (i.e. yellow, magenta, cyan and black), and, for example, transparent color imaging units 20CL and 20CL for transferring toner images of a transparent color. Thus, toner images formed in accordance with image information about the respective colors can be primarily transferred to the intermediate transfer belt 30.

The six imaging units 20CL, 20CL, 20Y, 20M, 20C and 20K are disposed in order of the transparent color, the transparent color, yellow, magenta, cyan and black in the rotation direction of the intermediate transfer belt 30. The imaging units for the transparent color may be replaced by, for example, light color imaging units for transferring toner image of light colors such as light yellow, light magenta, light cyan or light black. Alternatively, the imaging unit 20CL for the transparent color and an imaging unit for a light color may be provided side by side.

Each imaging unit 20 has a photoconductor drum (an example of an image retainer) 21, a charging unit 22 for charging the surface of the photoconductor drum 21 to a predetermined electric potential, an exposure unit 23 for radiating laser light L onto the charged photoconductor drum 21 to form an electrostatic latent image on the photoconductor drum 21, a developing device 80 for developing the electrostatic latent image formed on the photoconductor drum 21 by the exposure unit 23 to form a toner image, a primary transfer roll 25 for transferring the toner image on the photoconductor drum 21 to the intermediate transfer belt 30 in a primary transfer portion, and a drum cleaner 26 for removing residual toner or paper powder from the surface of the photoconductor drum 21 after the toner image is transferred. A toner cartridge TC for supplying a developing agent to the developing device 80 is placed above each imaging unit 20.

The primary transfer roll 25 of each imaging unit 20 is disposed to hold the intermediate transfer belt 30 between the primary transfer roll 25 and the photoconductor drum 21. A transfer bias voltage with reverse polarity to the charge polarity of toner is applied to the primary transfer roll 25 to form an electric field between the photoconductor drum 21 and the primary transfer roll 25. Thus, the toner image charged on the photoconductor drum 21 can be transferred to the intermediate transfer belt 30 by Coulomb's force. The photoconductor drum 21 rotates clockwise during the primary transfer.

The intermediate transfer belt 30 is a member where toner images of color components formed by the imaging units 20 respectively are sequentially transferred (primarily transferred) and retained. The intermediate transfer belt 30 is formed endlessly to be laid on a plurality of support rolls 31*a* to 31*f* and the backup roll 41 so that the intermediate transfer belt 30 can receive primary transfer of toner images formed by the respective color imaging units 20CL, 20Y, 20M, 20C and 20K while rotating circumferentially counterclockwise.

The pair of the backup roll 41 and the secondary transfer roll 42 correspond to a mechanism portion by which the toner images multiply transferred on the intermediate transfer belt 30 can be transferred collectively (secondarily transferred) onto a sheet of paper or the like to form a full color image thereon. The backup roll 41 and the secondary transfer roll 42 are disposed to be opposed to each other with interposition of the intermediate transfer belt 30. The portion where the backup roll 41 and the secondary transfer roll 42 are opposed to each other corresponds to a secondary transfer portion.

The backup roll 41 is rotatably placed on the back surface side of the intermediate transfer belt 30. The secondary transfer roll 42 is rotatably placed to be opposed to a toner image transfer surface of the intermediate transfer belt 30. The backup roll 41 and the secondary transfer roll 42 are disposed to allow their rotation axes (perpendicular to the paper of FIG. 1) to run along each other.

Toner images on the intermediate transfer belt 30 are transferred as follows. That is, a voltage with the same polarity as the charge polarity of toner is applied to the backup roll 41 or a voltage with reverse polarity to the charge polarity of toner is applied to the secondary transfer roll 42. Thus, unfixed toner images retained on the intermediate transfer belt 30 are transferred onto a sheet of paper due to a transfer electric field formed between the backup roll 41 and the secondary transfer roll 42 opposed thereto.

Paper sheets with various sizes are received in the paper feed trays 50*a* and 50*b*. One of the sheets of paper in the paper feed tray 50*a* or 50*b* is extracted by a pickup roll (not shown) of the paper conveyance system 60, and then introduced into the secondary transfer portion at timing controlled by registration rolls 62 of the paper conveyance system 60. Thus, toner images are transferred onto the sheet of paper. After that, the sheet of paper is passed through a conveyance belt 63 of the paper conveyance system 60 and conveyed to the fixing unit 70. The toner images are fixed on the sheet of paper by a heating roll 70*a* and a pressure roll 70*b* of the fixing unit 70. The sheet of paper is then discharged to the outside of the image forming apparatus 1 by a discharge roller (not shown).

Figure 2:
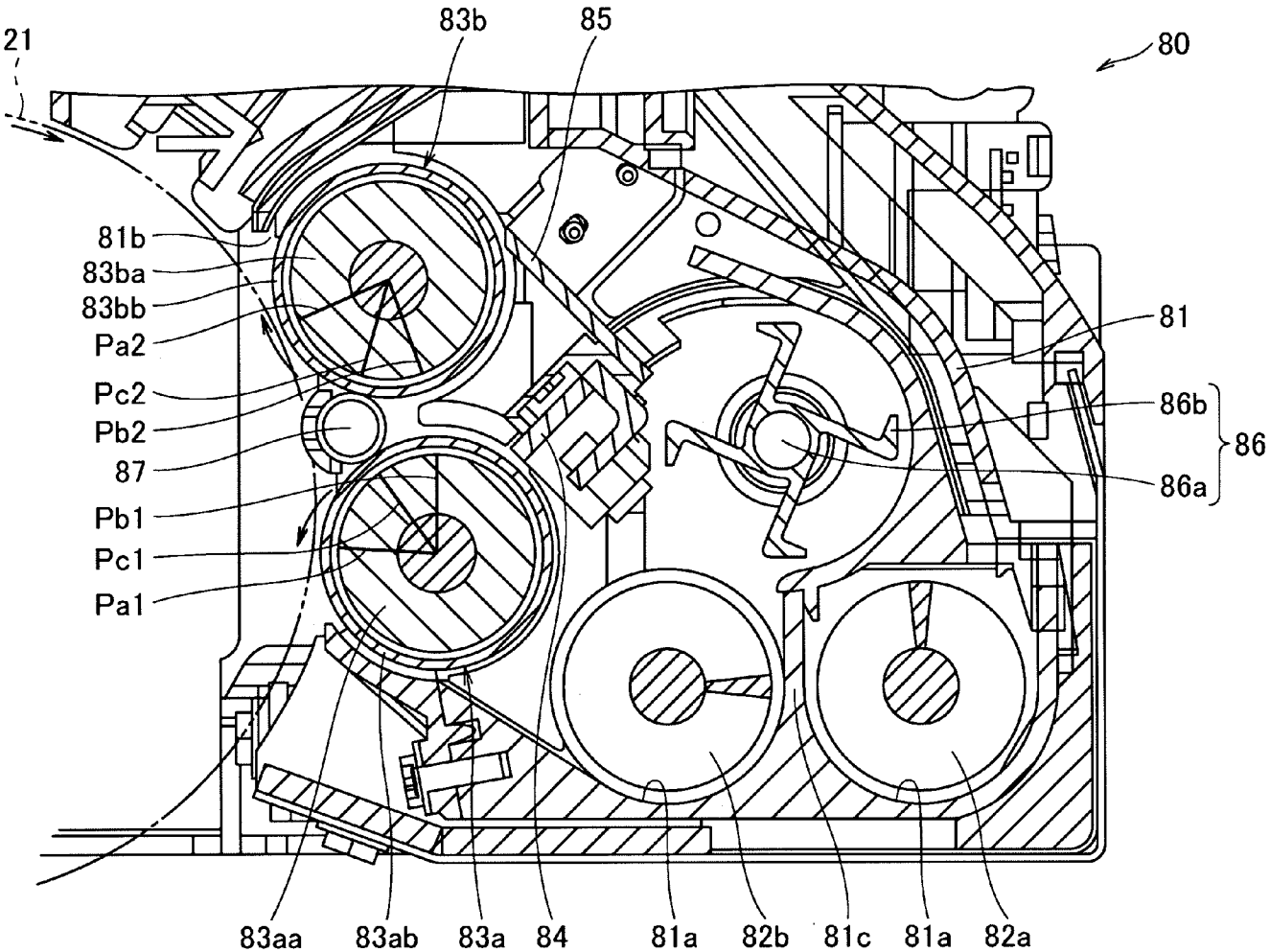
FIG. 2 is a sectional view of an example of a developing device of the image forming apparatus in FIG. 1.

Next, the developing device 80 will be described with reference to FIGS. 2 to 6. FIG. 2 shows a main portion sectional view of an example of the developing device 80, and FIGS. 3 to 6 show main portion perspective views of the developing device 80.

The developing device 80 has a housing (an example of a support member) 81 serving as a support frame. In addition, the developing device 80 has two conveyance members 82*a* and 82*b*, two developing rolls (examples of a first developing body and a second developing body) 83*a* and 83*b*, a layer thickness limiting member 84, a conveyance guide 85, a rotary conveyor 86 and a seal roll (an example of a sealing member) 87 which are supported in the housing 81.

A developing agent reservoir portion 81*a* and an opening portion 81*b* are formed in the housing 81. For example, a dual-component developing agent including toner and magnetic carrier is received in the developing agent reservoir portion 81*a*. The opening portion 81*b* is formed in a position opposed to the photoconductor drum 21.

The two conveyance members 82*a* and 82*b* are received in the developing agent reservoir portion 81*a*. The conveyance members 82*a* and 82*b* are members for conveying the dual-component developing agent to the developing rolls 83*a* and 83*b* while stirring and mixing the dual-component developing agent. The conveyance members 82*a* and 82*b* are rotatably disposed in opposite, left and right regions with interposition of a partition wall 81*c* in the developing agent reservoir portion 81*a*. The conveyance members 82*a* and 82*b* are disposed side by side so that directions of their rotation shafts (perpendicular to the paper of FIG. 2) can run along directions of the rotation shafts of the developing rolls 83*a* and 83*b* (see FIGS. 3 and 4).

For example, coiled or spiral rotation members are formed in the outer circumferences of the rotation shafts of the conveyance members 82*a* and 82*b* so that the dual-component developing agents in the respective regions of the developing agent reservoir portion 81*a* can be conveyed in opposite directions to each other in the directions of the rotation shafts of the conveyance members 82*a* and 82*b*, respectively. Opening portions are provided in the partition wall 81*c* on the opposite end sides in the directions of the rotation shafts of the conveyance members 82*a* and 82*b* so that the developing agents in the regions partitioned by the partition wall 81*c* can be delivered through the opening portions so as to circulate and move.

Of the two conveyance members 82*a* and 82*b*, the left conveyance member 82*b* on the downstream side of conveyance in FIG. 2 is disposed to be opposed to the lower developing roll 83*a* at a predetermined distance therefrom. The dual-component developing agent can be delivered from the conveyance member 82*b* to the lower developing roll 83*a* through the portion where the conveyance member 82*b* is opposed to the developing roll 83*a*.

The developing rolls 83*a* and 83*b* are members for developing an image on the surface of the photoconductor drum 21 (an example of a development surface) using the developing agent. A part of the outer circumferential surface of each developing roll 83*a*, 83*b* is exposed through the opening portion 81*b* so that the developing rolls 83*a* and 83*b* can be disposed above and below and side by side so as to be opposed to the surface of the photoconductor drum 21. The developing rolls 83*a* and 83*b* are disposed side by side so that the directions of their rotation shafts (perpendicular to the paper of FIG. 2) can run along the direction of the rotation shaft (perpendicular to the paper of FIG. 2) of the photoconductor drum 21 (see FIGS. 3 to 6).

The outer circumferential surface of each developing roll 83*a*, 83*b* is opposed to the outer circumferential surface of the photoconductor drum 21 at a predetermined distance therefrom, so that toner can be supplied from the developing roll 83*a*, 83*b* to the photoconductor drum 21 through the opposed portion (a developing nip portion, a developing pole). The distance between the outer circumferential surface of the developing roll 83*a*, 83*b* and the outer circumferential surface of the photoconductor drum 21 is set at, for example, about ±20 to 30 μm.

In addition, the outer circumferential surfaces of the upper and lower developing rolls 83*a* and 83*b* are opposed to each other at a predetermined distance so that the developing agent can be delivered from the lower developing roll 83*a* to the upper developing roll 83*b* through the opposed portion.

Each developing roll 83*a*, 83*b* has a magnet roll (an example of a magnetic pole forming piece) 83*aa*, 83*ba*, and a cylindrical sleeve (an example of a rotation member) 83*ab*, 83*bb* disposed on the outer circumference of the magnet roll 83*aa*, 83*ba*. The magnet roll 83*aa*, 83*ba* is fixedly supported on the housing 81, and the sleeve 83*ab*, 83*bb* is supported rotatably along the outer circumferential surface of the magnet roll 83*aa*, 83*ba*.

A plurality of magnetic poles are magnetized circumferentially in each magnet roll 83*aa*, 83*ba*. The lower magnet roll 83*aa* has a first developing pole Pa1, a first delivery pole Pb1, and a first conveyance pole Pc1 disposed therebetween. On the other hand, the upper magnet roll 83*ba* has a second developing pole Pa2, a second delivery pole Pb2, and a second conveyance pole Pc2 disposed therebetween.

The first developing pole Pa1 and the second developing pole Pa2 are formed in positions opposed to and close to the photoconductor drum 21. The first developing pole Pa1 and the second developing pole Pa2 are formed as magnetic poles for performing development. The first delivery pole Pb1 and the second delivery pole Pb2 are formed in positions opposed to and close to the developing rolls 83*a* and 83*b*. The first delivery pole Pb1 and the second delivery pole Pb2 are formed as magnetic poles for performing delivery of the developing agent between the developing rolls 83*a* and 83*b*. The first conveyance pole Pc1 and the second conveyance pole Pc2 are formed as magnetic poles for conveying the developing agent from the first delivery pole Pb1 to the first developing pole Pa1 and from the second delivery pole Pb2 to the second developing pole Pa2 respectively.

Thus, the developing agent can be delivered between the two developing rolls 83*a* and 83*b* while the toner is supplied to the photoconductor drum 21. Each magnetic pole is magnetized to extend in the direction of the rotation shaft of the magnet roll 83*aa*, 83*ba* so that a magnetic field is formed around any position in the direction of the rotation shaft.

The sleeves 83*ab* and 83*bb* are formed out of a nonmagnetic material such as aluminum, brass, stainless steel or conductive resin. The sleeve 83*ab* of the lower developing roll 83*a* rotates in the same direction as the rotation direction of the photoconductor drum 21 in the portion where the sleeve 83*ab* is opposed to the photoconductor drum 21. The sleeve

83*bb* of the upper developing roll 83*b* rotates in an opposite direction to the rotation direction of the photoconductor drum 21 in the portion where the sleeve 83*bb* is opposed to the photoconductor drum 21.

Since the sleeve 83*bb* of the upper developing roll 83*b* rotates in the opposite direction to the rotation of the photoconductor drum 21, the developing performance is indeed high but a defect portion appears in the development. On the other hand, since the sleeve 83*ab* of the lower developing roll 83*a* rotates in the forward direction with respect to the rotation of the photoconductor drum 21, the sleeve 83*ab* has a function of compensating the defect of the development generated by the upper developing roll 83*b*. As a result, due to the developing rolls 83*a* and 83*b* provided in two stages, it is possible to increase the speed and the image quality while avoiding temperature rise caused by the high speed of rotation.

The layer thickness limiting member 84 is a plate-like member for limiting the layer thickness of the dual-component developing agent conveyed from the conveyance member 82*b* to the developing rolls 83*a* and 83*b*. The layer thickness (developing agent amount) of the dual-component developing agent delivered from the conveyance member 82*b* to the lower developing roll 83*a* is limited by the layer thickness limiting member 84. After that, the dual-component developing agent is conveyed to the opposed portion (a developing nip portion, a developing pole) of each developing roll 83*a*, 83*b* to the photoconductor drum 21.

A front end portion of the layer thickness limiting member 84 is disposed to be opposed to the outer circumference of the lower developing roll 83*a* at a distance corresponding to a predetermined layer thickness value of the developing agent. The dual-component developing agent is formed into a thin layer while being frictionally charged due to magnetic interaction between the front end portion of the layer thickness limiting member 84 and the magnet roll 83*aa* of the lower developing roll 83*a*. Thus, the dual-component developing agent can be retained on the surface of the sleeve 83*ab* of the lower developing roll 83*a*. The layer thickness limiting member 84 is disposed so that its longitudinal direction (perpendicular to the paper of FIG. 2) can run along the direction of the rotation shaft of the lower developing roll 83*a*.

The conveyance guide 85 is a path forming member for forming a path through which the developing agent not used for development but remaining on the upper developing roll 83*b* can be conveyed to the rotary conveyor 86. The conveyance guide 85 is disposed between the upper developing roll 83*b* and the rotary conveyor 86 and just above the layer thickness limiting member 84 so as to be inclined from the upper developing roll 83*b* toward the rotary conveyor 86.

The developing agent remaining on the upper developing roll 83*b* after development migrates to the conveyance guide 85 due to the repulsive force of the magnet roll 83*ba* in a separation region and the rotational centrifugal force of the developing roll 83*b*, and slides on the inclined surface as it is. Thus, the developing agent is sent to the rotary conveyor 86. The conveyance guide 85 is, for example, composed of stainless steel or aluminum as its primary material. The conveyance guide 85 is disposed so that its longitudinal direction (perpendicular to the paper of FIG. 2) can run along the directions of the rotation shafts of the developing roll 83*b* and the rotary conveyor 86.

The rotary conveyor 86 is a member for sending the developing agent remaining on the upper developing roll 83*b* back into the developing agent reservoir portion 81*a*. The rotary conveyor 86 is disposed rotatably clockwise just above and between the conveyance members 82*a* and 82*b* and adjacently (on the right in FIG. 2) to the layer thickness limiting member 84. The rotary conveyor 86 is disposed so that the direction of its rotation shaft (perpendicular to the paper of FIG. 2) can run along the directions of the rotation shafts of the developing rolls 83*a* and 83*b* and the conveyance members 82*a* and 82*b*.

Four rotary blades 86*b* each having an L-shape in section are formed on the outer circumference of a rotation shaft 86*a* of the rotary conveyor 86. Each rotary blade 86*b* is folded into an L-shape in section so as to hold the developing agent conveyed thereto. This is because the rotary conveyor 86 is rotated at a low speed to reserve the developing agent on the rotary conveyor 86 so that the volume of the reserved developing agent can be increased without increasing the size of the developing device 80.

In the developing device 80 having the two stages of the developing rolls 83*a* and 83*b* as described above, there is a problem that a large amount of toner cloud occurs in the portion where the developing agent is delivered between the developing rolls 83*a* and 83*b*.

In the developing device 80 according to the embodiment, the seal roll 87 is therefore disposed rotatably around its rotation shaft between the region where the first delivery pole Pb1 and the second delivery pole Pb2 of the developing rolls 83*a* and 83*b* are opposed and the surface of the photoconductor drum 21, so as to prevent the toner cloud from leaking to the outside of the developing device 80. The seal roll 87 is disposed so that the direction of its rotation shaft (perpendicular to the paper of FIG. 2) can run along the directions of the rotation shafts of the developing rolls 83*a* and 83*b* (see FIGS. 3 to 6).

Figure 7:
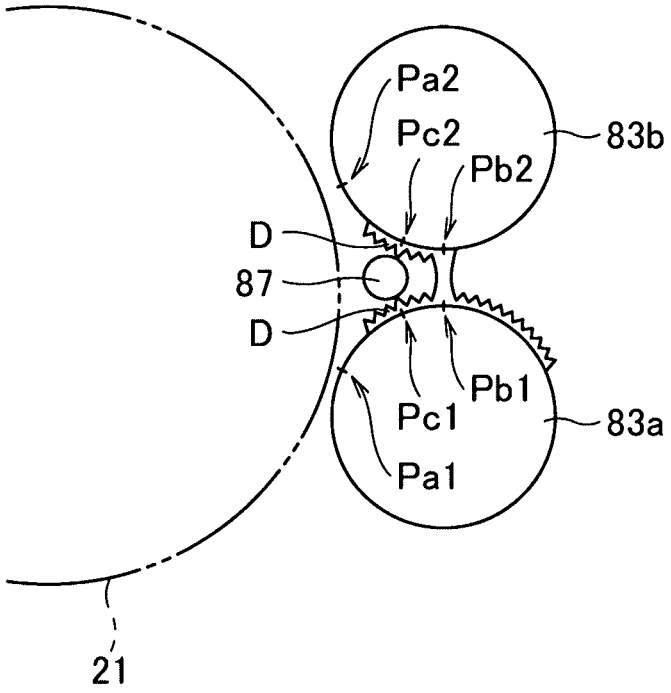
FIG. 7 is a conceptual view showing a state where a seal roll of the developing device in FIG. 2 seals off toner.

Here, FIG. 7 shows a state where the seal roll 87 seals off toner. The seal roll 87 is composed of a magnetic material. The seal roll 87 is disposed adjacently to the developing rolls 83*a* and 83*b* at distances so small that developing agents D formed as magnetic brushes on the first conveyance pole Pc1 and the second conveyance pole Pc2 of the developing rolls 83*a* and 83*b* can touch the seal roll 87.

Thus, the developing agents D formed as magnetic brushes on the first conveyance pole Pa and the second conveyance pole Pc2 of the developing rolls 83*a* and 83*b* respectively touch the seal roll 87 like bridges to thereby close the distances between the developing rolls 83*a* and 83*b* and the seal roll 87 respectively.

Thus, the toner cloud generated between the first delivery pole Pb1 and the second delivery pole Pb2 can be suppressed or prevented from leaking to the outside of the developing device 80. As a result, the amount of floating toner leaking to the outside of the developing device 80 is reduced to elongate the cycle for exchange of a toner recovery filter.

In the developing device 80 having the two stages of the developing rolls 83*a* and 83*b* as described above, the inside of the image forming apparatus 1 may be contaminated with the toner cloud generated in the two developing nip portions during development.

In the developing device 80 according to the embodiment, predetermined electric potential is therefore applied to the seal roll 87 in order to absorb the toner cloud generated in the two developing nip portions. More particularly, the same electric potential as the electric potential applied to each developing roll 83*a*, 83*b* is applied to the seal roll 87.

Thus, the toner cloud generated between each of the first developing pole Pa1 and the second developing pole Pa2 of the developing rolls 83*a* and 83*b* and the surface of the photoconductor drum 21 is attached to the seal roll 87 so as to suppress or prevent the toner cloud from leaking to the outside of the developing device 80. As a result, the amount of floating toner leaking to the outside of the developing device 80 is reduced to elongate the cycle for exchange of the toner recovery filter.

Figure 8:
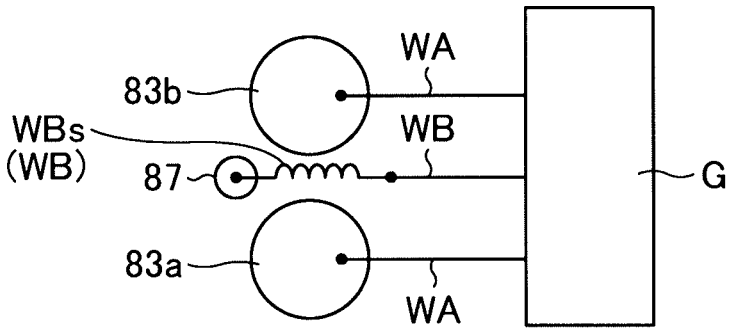
FIG. 8 is a conceptual view of a circuit for applying electric potential to the seal roll of the developing device in FIG. 2.

Here, FIG. 8 shows a conceptual view of a circuit for applying the electric potential to the seal roll 87. A power supply circuit G is electrically connected to the developing rolls 83*a* and 83*b* and the seal roll 87 through power feed wires WA and WB. A power feed wire WBs (see FIGS. 3, 4 and 8) composed of a tension spring lies in the path of the power feed wire WB connecting the power supply circuit G and the seal roll 87, so as to supply a power supply voltage to the seal roll 87 performing rotation operation.

In addition, the developing device 80 according to the embodiment is configured to attach toner cloud to the seal roll 87 as described above. However, the toner adhering to the seal roll 87 may be deposited in a short time if it is left as it is. The deposited toner may fall down to the lower developing roll 83*a* and cause a failure of image defect (toner dropping).

In the developing device 80 according to the embodiment, therefore, the toner adhering to the seal roll 87 is rotated so that the toner can be recovered and cleaned by the developing agent D (see FIG. 7) formed as magnetic brushes on each of the first conveyance pole Pa and the second conveyance pole Pc2 of the developing rolls 83*a* and 83*b*. During the cleaning of the seal roll 87, the developing rolls 83*a* and 83*b* are also rotated. In addition, after the cleaning, the rotational position (posture) of the seal roll 87 comes back to a predetermined rotational position (posture).

Figure 6:
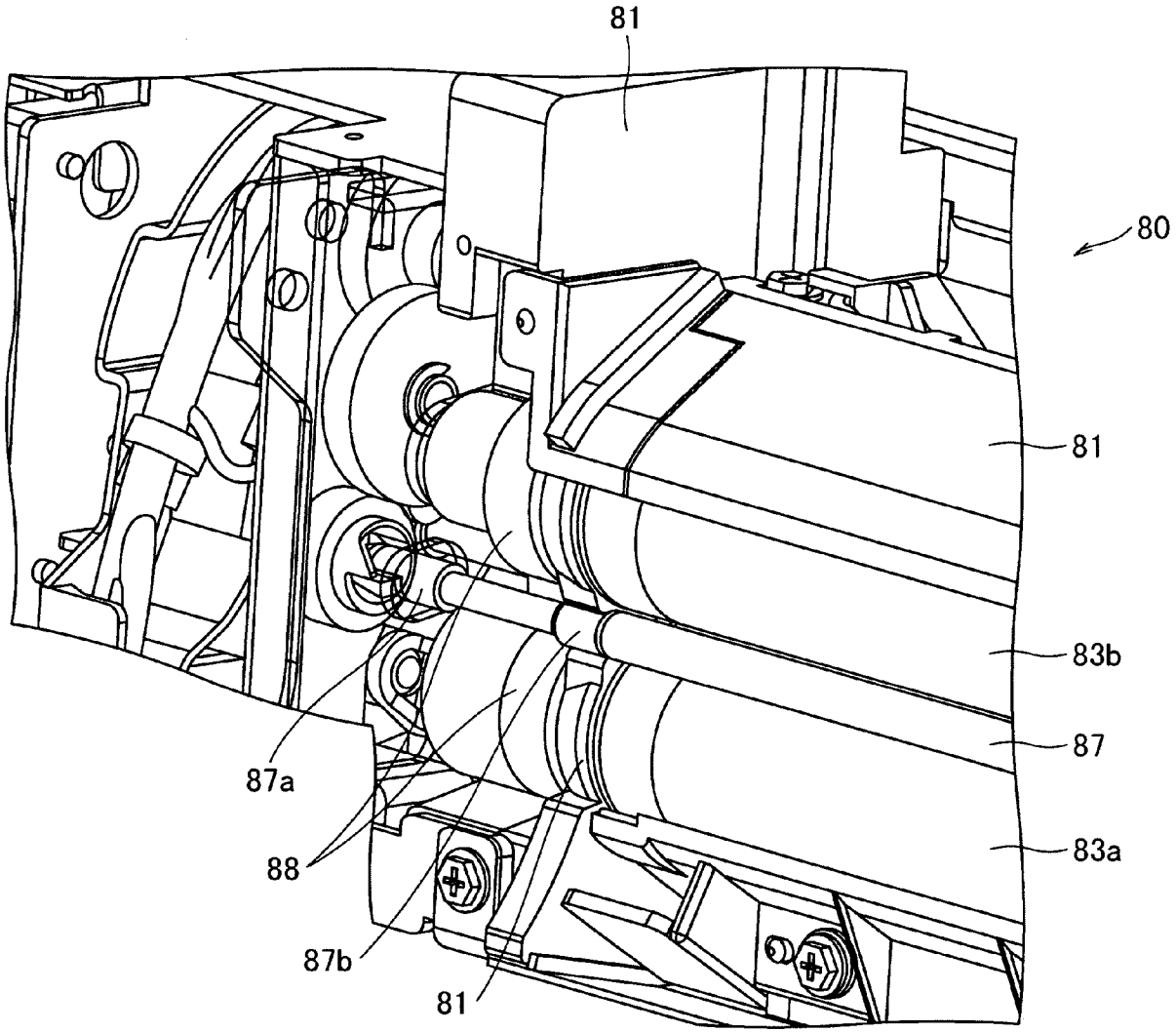
FIG. 6 is a main portion perspective view of the developing device in FIG. 2.

Thus, the toner adhering to the seal roll 87 is cleaned up so that the amount of the deposited toner on the seal roll 87 can be reduced. As a result, the toner falling down from the seal roll 87 is reduced or prevented so that a failure of image defect can be suppressed or prevented. As shown in FIG. 6, the seal roll 87 is coupled to a rotary driver (not shown) such as a stepping motor through a coupling portion 87*a* provided in an end portion of the seal roll 87.

In addition, the seal roll 87 may be provided with a function (smoothing function) of limiting the layer thickness of developing agents conveyed from the first conveyance pole Pc1 and the second conveyance pole Pc2 of the developing rolls 83*a* and 83*b* to the first developing pole Pa1 and the second developing pole Pa2 respectively.

In that case, the developing agents on the first delivery pole Pb1 and the second delivery pole Pb2 of the developing rolls 83*a* and 83*b* are limited and smoothed in layer thickness (developing agent amount) while being frictionally charged due to magnetic interaction between the first conveyance pole Pc1 and the second conveyance pole Pc2 of the developing rolls 83*a* and 83*b* and the seal roll 87. After that, the developing agents are conveyed to the first developing pole Pa1 and the second developing pole Pa2 of the developing rolls 83*a* and 83*b*.

In this manner, the seal roll 87 has the function of limiting the layer thickness and the function of self-cleaning in addition to the function of preventing toner leakage. Thus, the cost of the developing device 80 can be reduced on a large scale as compared with the case where these functions are provided separately.

In the developing device 80 according to the embodiment, the distances between the two developing rolls 83*a* and 83*b* and the seal roll 87 must be set accurately. In addition, the distances between the two developing rolls 83*a* and 83*b* and the photoconductor drum 21 must be set with a high accuracy of about ±20 to 30 μm. Particularly the distances between the two developing rolls 83*a* and 83*b* and the photoconductor drum 21 are set by a total of four tracking rolls 88 provided in the opposite ends of the two developing rolls 83*a* and 83*b* as shown in FIGS. 3 to 6. It is however difficult to adjust all the four tracking rolls 88 simultaneously.

Therefore, in the developing device 80 according to the embodiment, the tracking rolls 88 placed at three places of the two developing rolls are fixed while the remaining one tracking roll 88 is made movable so that the remaining one tracking roll 88 can be positioned after the three tracking rolls 88 are positioned.

Figure 9:
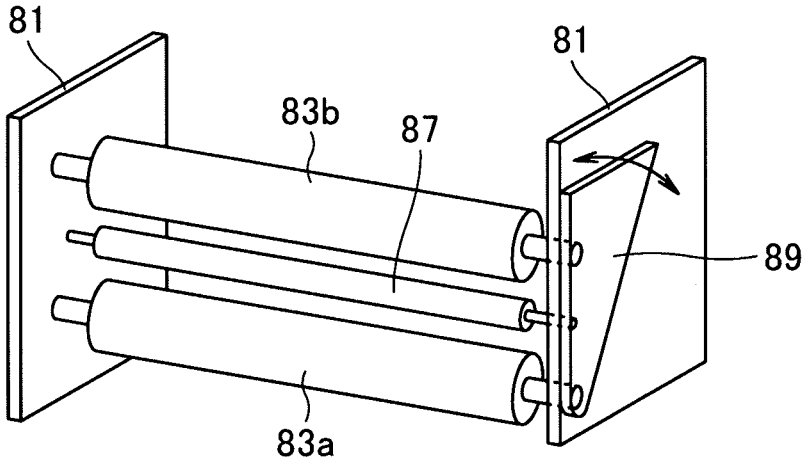
FIG. 9 is a conceptual view of a positioning mechanism of the developing device in FIG. 2, which positions two stages of developing rolls and a photoconductor drum.

Here, FIG. 9 shows a conceptual view of a positioning mechanism for setting the distances between the developing rolls 83*a* and 83*b* and the seal roll 87 and the distances between the developing rolls 83*a* and 83*b* and the photoconductor drum 21.

Figure 5:
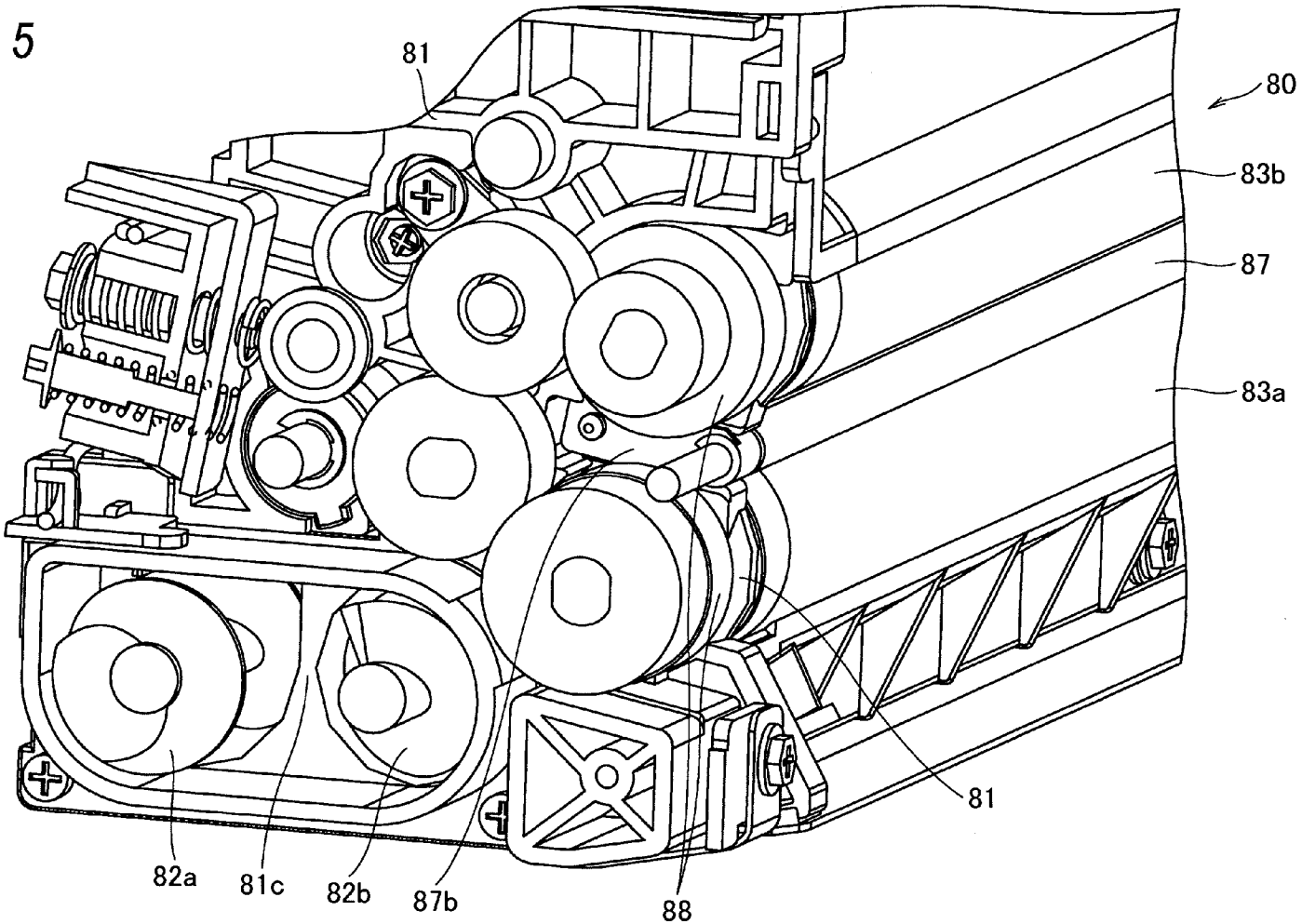
FIG. 5 is a main portion perspective view of the developing device in FIG. 2.

The two developing rolls 83*a* and 83*b* and the seal roll 87 are supported on the housing 81 on their one axial end sides respectively while keeping the distances between the two developing rolls 83*a* and 83*b* and the seal roll 87. To explain in detail, a bearing portion 87*b* on one end side of the seal roll 87 and bearing portions (not shown) on one end sides of the two developing rolls 83*a* and 83*b* are fixed to the housing 81, as shown in FIGS. 5 and 6. The tracking rolls 88 on one end sides of the two developing rolls 83*a* and 83*b* are also fixed.

Figure 3:
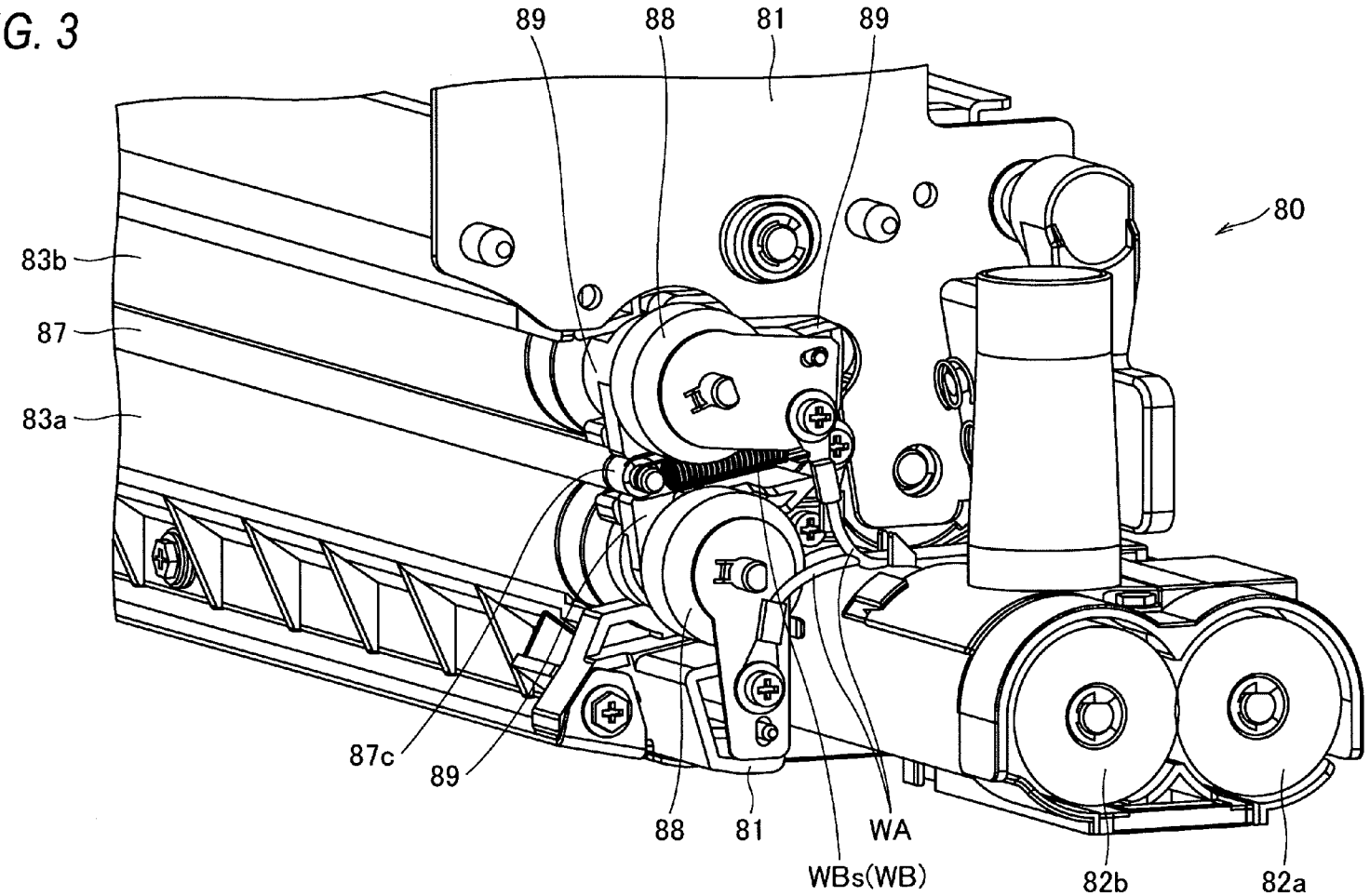
FIG. 3 is a main portion perspective view of the developing device in FIG. 2.
Figure 4:
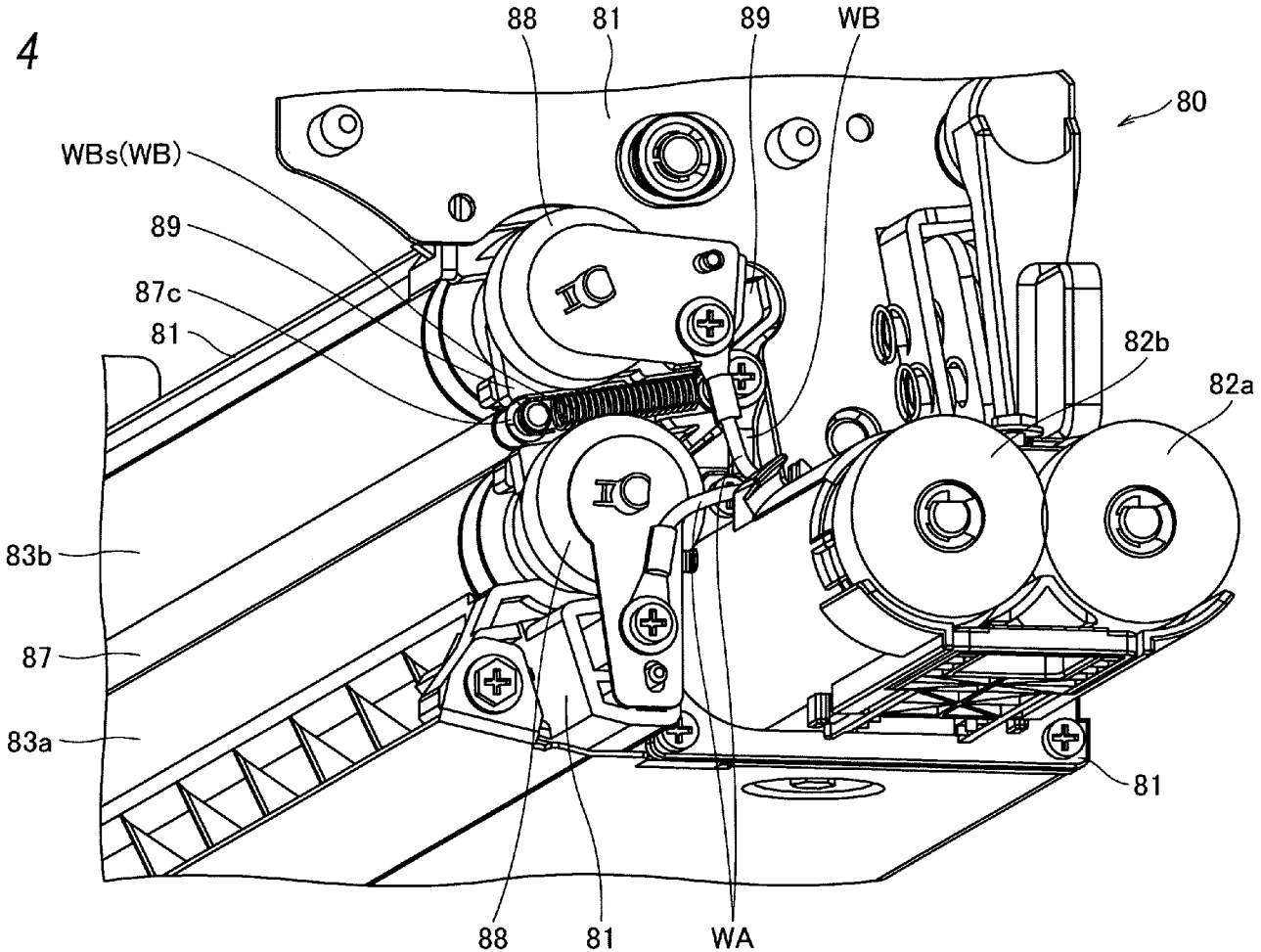
FIG. 4 is a main portion perspective view of the developing device in FIG. 2.

On the other hand, as shown in FIG. 9, the other axial end sides of the two developing rolls 83*a* and 83*b* and the seal roll 87 are supported on a positioning member 89 while keeping the distances between the two developing rolls 83*a* and 83*b* and the seal roll 87. To explain in detail, a bearing portion 87*c* on the other end side of the seal roll 87 and bearing portions (not shown) on the other end sides of the two developing rolls 83*a* and 83*b* are fixed to the positioning member 89, as shown in FIGS. 3 and 4.

As shown in FIG. 9, the positioning member 89 is supported on the housing 81 rotatably, both forward and backward as shown by the arrows, around a support portion (rotation shaft) on the other axial end side of the lower developing roll 83*a*, so that the relative position (distance) between the upper developing roll 83*b* and the surface of the photoconductor drum 21 can be determined by the forward and backward rotational operation of the positioning member 89. To this end, the tracking roll 88 on the other end side of the lower developing roll 83*a* is fixed while the tracking roll 88 on the other end side of the upper developing roll 83*b* is movable in the direction in which the tracking roll 88 approaches the surface of the photoconductor drum 21 and in the direction in which the tracking roll 88 leaves the surface of the photoconductor drum 21.

For example, the distances between the two developing rolls 83*a* and 83*b* and the surface of the photoconductor drum 21 are set as follows. First, two tracking rolls 88 on one end sides of the two developing rolls 83*a* and 83*b* and one tracking roll 88 on the other end side of the lower developing roll 83*a* are brought into abutment against tracking roll contact regions of the photoconductor drum 21 so as to set the distance between the lower developing roll 83*a* and the surface of the photoconductor drum 21. After that, the positioning member 89 is rotated to approach the surface of the photoconductor drum 21. Thus, the tracking roll 88 on the other end side of the upper developing roll 83*b* is brought into abutment against a tracking roll contact region of the photoconductor drum 21 so as to set the distance between the upper developing roll 83*b* and the surface of the photoconductor drum 21.

In this manner, the distances between the two developing rolls 83*a* and 83*b* and the surface of the photoconductor drum 21 are set accurately while keeping the distances between the two developing rolls 83*a* and 83*b* and the seal roll 87. Accordingly, in the image forming apparatus 1 provided with the developing device 80, a high-quality image can be formed on a paper sheet by high-speed processing.

Next, an example of operation of the developing device 80 configured thus will be described with reference to FIG. 2 and so on.

The dual-component developing agent received in the developing agent reservoir portion 81*a* of the developing device 80 is stirred and mixed by the conveyance members 82*a* and 82*b*, and supplied to the surface of the lower developing roll 83*a*. The dual-component developing agent adsorbed on the surface of the sleeve 83*ab* of the lower developing roll 83*a* due to a magnetic pole of the magnet roll 83*aa* of the lower developing roll 83*a* is sent to the layer thickness limiting member 84 due to the rotation of the sleeve 83*ab*. The dual-component developing agent is limited in layer thickness (developing agent amount) and retained on the surface of the sleeve 83*ab* while being frictionally charged due to magnetic interaction between the layer thickness limiting member 84 and the magnet roll 83*aa* of the developing roll 83*a*.

The developing agent passing through the layer thickness limiting member 84 is formed into a thin layer, retained on the sleeve 83*ab* of the lower developing roll 83*a*, conveyed to the position opposed to the upper developing roll 83*b* (the delivery portion where the first delivery pole Pb1 and the second delivery pole Pb2 are opposed to each other) and almost evenly divided into two, one of which is delivered onto the upper developing roll 83*b* while the other is retained and conveyed on the sleeve 83*ab* of the lower developing roll 83*a*.

The developing agent retained on the sleeve 83*ab* of the lower developing roll 83*a* is conveyed to the portion (the developing nip portion, the first developing pole Pa1) opposed to the photoconductor drum 21, through the first conveyance pole Pc1 due to the rotation of the sleeve 83*ab*. Toner of the developing agent is transferred to the electrostatic latent image of the photoconductor drum 21 due to the developing bias voltage applied between the lower developing roll 83*a* and the photoconductor drum 21.

On the other hand, the developing agent retained on the sleeve 83*bb* of the upper developing roll 83*b* is conveyed to the portion (the developing nip portion, the second developing pole Pa2) opposed to the photoconductor drum 21, through the second conveyance pole Pc2 due to the rotation of the sleeve 83*bb*. Toner of the developing agent is transferred to the electrostatic latent image of the photoconductor drum 21 due to the developing bias voltage applied between the upper developing roll 83*b* and the photoconductor drum 21.

Here, in the developing device 80 according to the embodiment, the developing agents D (see FIG. 7) formed as magnetic brushes on the first conveyance pole Pc1 and the second conveyance pole Pc2 of the developing rolls 83*a* and 83*b* respectively close the distances between the developing rolls 83*a* and 83*b* and the seal roll 87 respectively. Thus, toner cloud generated between the first delivery pole Pb 1 and the second delivery pole Pb2 can be suppressed or prevented from leaking to the outside of the developing device 80.

In addition, in the developing device 80 according to the embodiment, predetermined electric potential is applied to the seal roll 87 to adsorb the toner cloud generated in the two developing nip portions, so that the toner cloud generated in the two developing nip portions can be suppressed or prevented from leaking to the outside of the developing device 80.

Further, for example, when the seal roll 87 is rotated every predetermined number of times of development or every predetermined number of sheets of paper processed, the toner adhering to the seal roll 87 is recovered by the developing agents D (see FIG. 7) formed as magnetic brushes on the first conveyance pole Pc1 and the second conveyance pole Pc2 of the developing rolls 83*a* and 83*b* respectively. Thus, the surface of the seal roll 87 is cleaned so that a failure of image defect caused by the toner deposited on the seal roll 87 and falling down to the lower developing roll 83*a* can be suppressed or prevented.

The developing agent which has not been used for development but remains on the sleeve 83*bb* of the upper developing roll 83*b* is separated due to the magnetic force effect in the separation region of the magnet roll 83*ba* of the upper developing roll 83*b* and the centrifugal force effect of the sleeve 83*bb* of the upper developing roll 83*b*. The separated developing agent is delivered to the conveyance guide 85.

The developing agent delivered to the conveyance guide 85 slides on the inclined surface of the conveyance guide 85 so as to be conveyed to the rotary conveyor 86. The developing agent is further conveyed to the developing agent reservoir portion 81*a*. After that, the same operations as described above are repeated.

For example, the embodiment has been described in the case where the embodiment is applied to an image forming apparatus of an intermediate transfer system in which a toner image transferred to an intermediate transfer belt is transferred to a sheet of paper. However, the invention is not limited thereto but may be applied to an image forming apparatus of a direct transfer system in which a toner image of a photoconductor drum is transferred directly to a sheet of paper (an example of a transfer medium and/or a recording medium).

Second Exemplary Embodiment

An embodiment as an example of the invention will be described in detail below with reference to the drawings. In the drawings for explaining the embodiment, the same constituent members are referred to by the same numerals correspondingly by principle so that redundant description thereof will be omitted.

Figure 10:
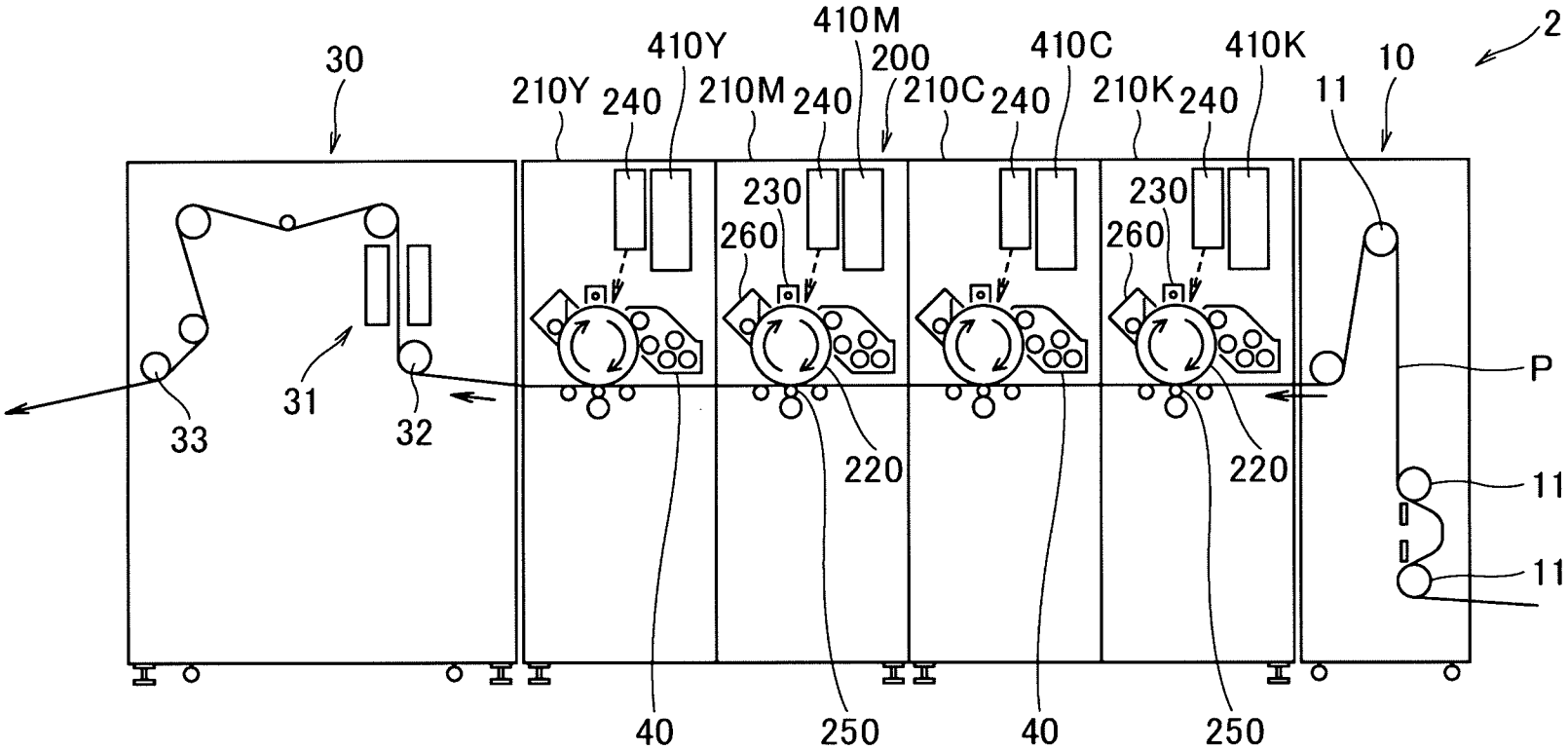
FIG. 10 is a conceptual view of an example of an image forming apparatus according to a second exemplary embodiment of the invention.
Figure 11:
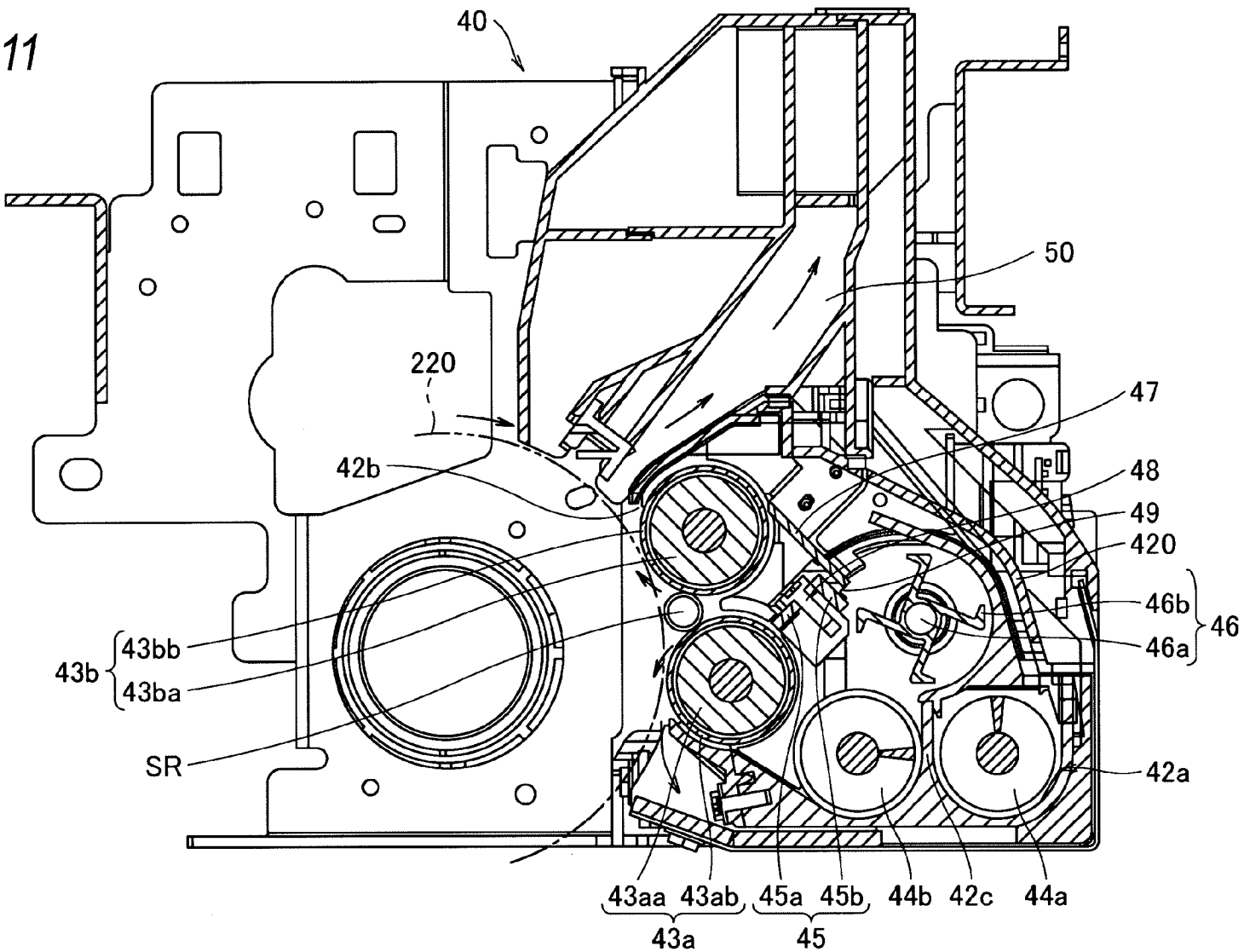
FIG. 11 is a sectional view showing a developing device of the image forming apparatus in FIG. 10 and a peripheral portion of the developing device.
Figure 12:
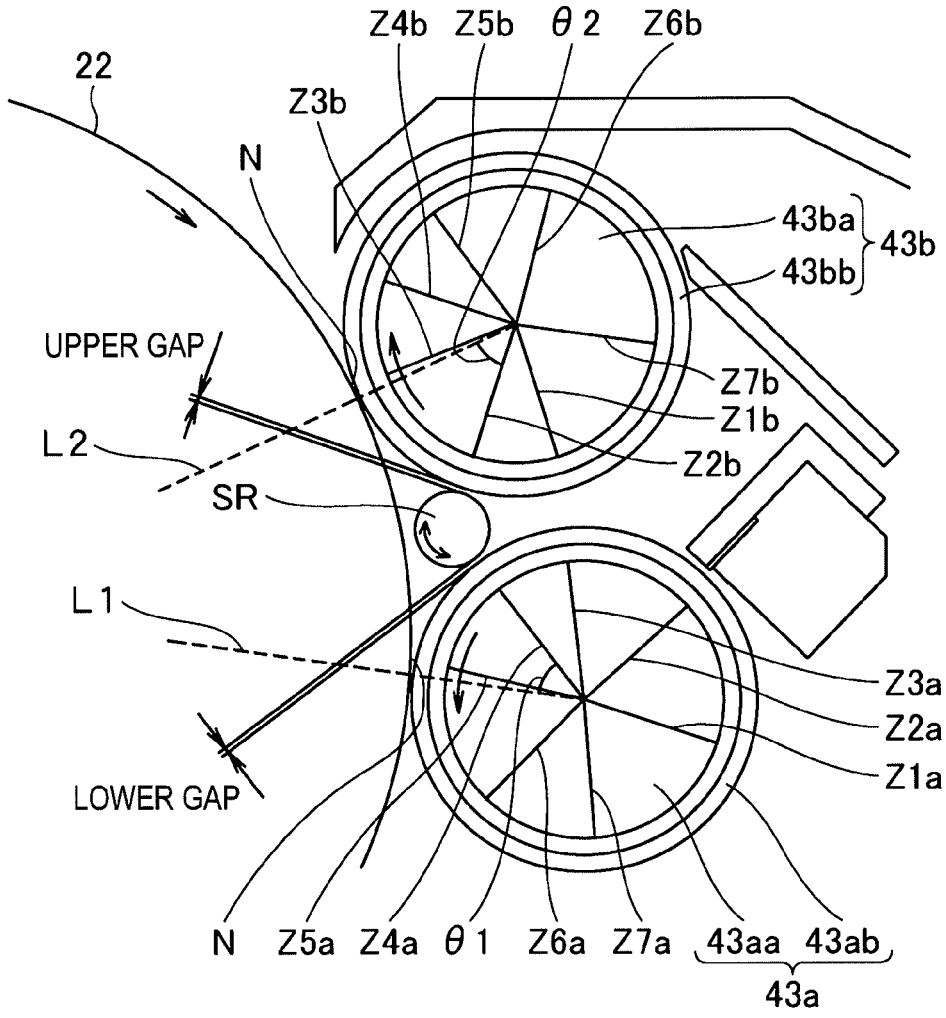
FIG. 12 is an explanatory view showing upper and lower developing rolls, a seal roll and a photoconductor drum of the image forming apparatus in FIG. 10.

FIG. 10 is a conceptual view of an example of an image forming apparatus according to a second exemplary embodiment of the invention.

The image forming apparatus 2 is a large-size machine for forming an image on continuous-feed paper (an example of a transfer medium and/or a recording medium) as a transfer material at a high speed. The image forming apparatus 2 has a paper conveyance portion 10 for conveying and supplying the continuous-feed paper P, an image forming portion 200 for forming an image and transferring the image onto the continuous-feed paper P, and a fixing portion 300 for fixing the transferred image.

A plurality of winding rolls 11 for winding and conveying the continuous-feed paper P are provided in the paper conveyance portion 10, so as to convey the continuous-feed paper P to the image forming portion 200 while applying tension to the continuous-feed paper P.

Four image forming units 210K, 210C, 210M and 210Y for transferring toners of black (K), cyan (C), magenta (M) and yellow (Y) to form toner images sequentially from the upstream side are provided along a conveyance path of the continuous-feed paper P in the image forming portion 200.

Each image forming unit 210K, 210C, 210M, 210Y is provided with a photoconductor drum (an example of an image retainer) 22 in which a photoconductive layer is formed in the outer circumferential surface of a cylindrical member consisting of a conductive material. A charging unit 230, an exposure unit 240, a developing device 40, a transfer roll (an example of a transfer unit) 25 and a cleaning unit 260 are provided around the photoconductor drum 220. The charging unit 230 charges the surface of the photoconductor drum 220. The exposure unit 240 irradiates the charged photoconductor drum 220 with image light to form an electrostatic latent image on the surface of the photoconductor drum 220. The developing device 40 transfers toner to the electrostatic latent image on the photoconductor drum 220 to form a toner image. The transfer roll 250 is opposed to the photoconductor drum 220 so that the toner image formed on the photoconductor drum 220 can be transferred onto the continuous-feed paper P. The cleaning unit 260 removes the toner remaining on the photoconductor drum 220 after a transfer process.

The four image forming units 210K, 210C, 210M and 210Y have the same configuration, except that the colors of toners received in the developing devices 40 respectively are different. Above each developing device 40, a toner supply vessel 410K, 410C, 410M, 410Y for supplying toner of a color corresponding to the toner the developing device 40 receives is provided so that toner to be consumed for development can be supplied.

The fixing portion 300 disposed on the downstream side of the image forming portion 200 is provided with a flash fusing unit 31 for fixing the unfixed toner image transferred onto the continuous-feed paper P in the image forming portion 200. The continuous-feed paper P on which the toner image has been transferred is wound on a conveyance roll 32 and guided to the flash fusing unit 31. The flash fusing unit 31 heats the toner by heat radiated from a heating source and fixes the toner image onto the continuous-feed paper P. The continuous-feed paper P on which the toner image has been fixed is wound on a discharge roll 33 and discharged to the outside of the apparatus.

FIG. 2 is a sectional view of each developing device 40 of the image forming apparatus 2 in FIG. 10 and a peripheral portion of the developing device 40.

The developing device 40 has a housing 420 serving as a support frame. A developing agent reservoir portion 42*a* and an opening portion 42*b* are formed in the housing 420. For example, a dual-component developing agent including toner and magnetic carrier is received in the developing agent reservoir portion 42*a*. The opening portion 42*b* is formed in a position opposed to the photoconductor drum 220.

In addition, a developing roll 43*a* (an example of a first developing body) and a developing roll 43*b* (an example of a second developing body), two conveyance members (an example of a conveyance unit) 44*a* and 44*b*, a layer thickness limiting member 45, a rotary conveyor 46 and a conveyance guide 47 are provided and supported inside the housing 420.

The developing rolls 43*a* and 43*b* are members for developing an image on the surface of the photoconductor drum 220 using the developing agent. A part of the outer circumferential surface of each of the developing rolls 43*a* and 43*b* is exposed through the opening portion 42*b* so that the developing rolls 43*a* and 43*b* are disposed above and below and side by side. The developing roll 43*a* is located in a lower stage, and the developing roll 43*b* is located in an upper stage. The developing rolls 43*a* and 43*b* are disposed side by side so that the directions of their rotation shafts (perpendicular to the paper of FIG. 2) can run along the direction of a rotation shaft (perpendicular to the paper of FIG. 2) of the photoconductor drum 220.

The outer circumferential surface of each developing roll 43*a*, 43*b* is opposed to the outer circumferential surface of the photoconductor drum 220 at a predetermined distance therefrom, so that toner can be supplied from the developing roll 43*a*, 43*b* to the photoconductor drum 220 through the opposed portion (a developing nip portion N, a portion corresponding to developing pole Z5*a*, Z3*b*).

In addition, the outer circumferential surfaces of the upper and lower developing rolls 43*a* and 43*b* are opposed to each other at a predetermined distance so that the developing agent can be delivered from the lower developing roll 43*a* to the upper developing roll 43*b* through the opposed portion.

Each developing roll 43*a*, 43*b* has a magnet roll (an example of a magnetic pole forming body) 43*aa*, 43*ba*, and a cylindrical sleeve (an example of a rotary member) 43*ab*, 43*bb* disposed on the outer circumference of the magnet roll 43*aa*, 43*ba*. The magnet roll 43*aa*, 43*ba* is fixedly supported on the housing 420, and the sleeve 43*ab*, 43*bb* is supported rotatably along the outer circumferential surface of the magnet roll 43*aa*, 43*ba*.

A plurality of magnetic pole portions are magnetized circumferentially in each magnet roll 43*aa*, 43*ba*. Thus, the developing agent can be magnetically adsorbed on the outer circumferential surface of each sleeve 43*ab*, 43*bb*.

In FIG. 3, a plurality of magnetic pole portions Z1*a* to Z7*a* constituting the magnet roll 43*aa* are magnetized with an adsorbing pole Z1*a*, a conveyance pole Z2*a*, a delivery pole Z3*a*, a sealing pole Z4*a*, a developing pole Z5*a*, a conveyance pole Z6*a* and a separation pole Z7*a*. The adsorbing pole Z1*a* absorbs the developing agent conveyed from the conveyance member 44*b*. The conveyance pole Z2*a* conveys the developing agent to an adjacent pole on the rotationally downstream side. The delivery pole Z3*a* delivers the developing agent to the magnet roll 43*ba*. The sealing pole Z4*a* performs sealing together with a seal roll SR which will be described later, so that toner in the developing device 40 can be prevented from leaking to the outside through the gap between the developing rolls 43*a* and 43*b*. The developing pole Z5*a* supplies toner to the surface of the photoconductor drum 220 so as to perform development. The separation pole Z7*a* separates the developing agent.

On the other hand, a plurality of magnetic pole portions Z1*b* to Z7*b* constituting the magnet roll 43*ba* are magnetized with a delivery pole Z1*b*, a sealing pole Z2*b*, a developing pole Z3*b*, a conveyance pole Z4*b*, a conveyance pole Z5*b*, a separation pole Z6*b* and a conveyance pole Z7*b*. The developing agent from the magnet roll 43*aa* is delivered to the delivery pole Z1*b*. The sealing pole Z2*b* performs sealing together with the seal roll SR which will be described later, so that toner in the developing device 40 can be prevented from leaking to the outside through the gap between the developing rolls 43*a* and 43*b*. The developing pole Z3*b* supplies toner to the surface of the photoconductor drum 220 so as to perform development. The conveyance pole Z4*b* conveys the developing agent to an adjacent pole. The separation pole Z6*b* separates the developing agent.

Thus, the developing agent can be delivered between the two developing rolls 43*a* and 43*b* while the toner is supplied to the photoconductor drum 220. Each magnetic pole portion is magnetized to extend in the direction of the rotation shaft of the magnet roll 43*aa*, 43*ba* so that a magnetic field is formed around any position in the direction of the rotation shaft.

In FIG. 2, the sleeves 43*ab* and 43*bb* are formed out of a nonmagnetic material such as aluminum, brass, stainless steel or conductive resin. The sleeve 43*ab* of the lower developing roll 43*a* rotates in a first rotation direction which is the same direction as the rotation direction of the photoconductor drum 220 in the portion where the sleeve 43*ab* is opposed to the photoconductor drum 220. The sleeve 43*bb* of the upper developing roll 43*b* rotates in an opposite direction (a second rotation direction) to the rotation direction of the photoconductor drum 220 in the portion where the sleeve 43*bb* is opposed to the photoconductor drum 220.

The lower developing roll 43*a* serves as a final developing roll for supplying toner to the photoconductor drum 220. Therefore, the amount of toner supplied to the photoconductor drum 220 is adjusted so that a good image can be formed.

In the embodiment, the rotational speed of the developing roll 43*a* located in the lower stage is 484 rpm, and the rotation speed of the developing roll 43*b* in the upper stage is 726 rpm. However, the invention is not limited to these rotational speeds.

The columnar nonmagnetic seal roll (an example of a sealing member) SR is provided between the upper and lower developing rolls 43*a* and 43*b* in two stages in the opening portion 42*b* of the housing 420. The seal roll SR is disposed so that the direction of its rotational shaft (perpendicular to the paper of FIG. 2) can run along the directions of the developing rolls 43*a* and 43*b*. The seal roll SR operates together with the sealing poles Z4*a* and Z2*b* so as to secure sealing to prevent the toner in the developing device 40 from leaking to the outside through the gap between the developing rolls 43*a* and 43*b*.

Developing bias voltages with the same polarity are applied to the developing rolls 43*a* and 43*b*, and a developing bias voltage which is the same voltage as the developing roll 43*b* located in the upper stage is applied to the seal roll RS.

The seal roll SR rotates at an interval which will be described later, in the first rotational direction, at a rotational speed which will be described later and for a duration which will be described later. However, the seal roll SR may rotate in the second rotational direction.

Figure 13:
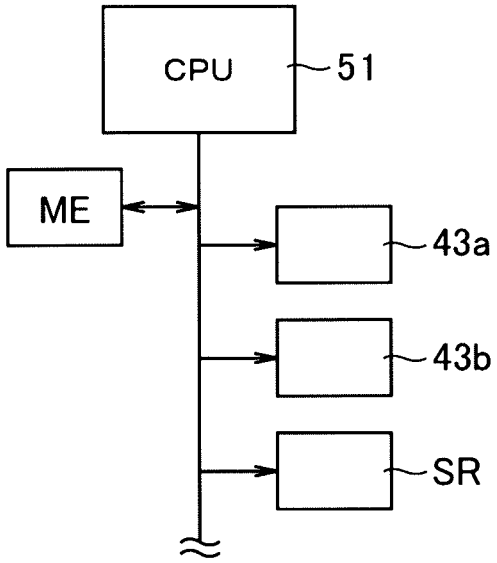
FIG. 13 is a circuit block diagram of a main portion of the image forming apparatus in FIG. 10.

As shown in FIG. 13, driving the developing roll 43*a*, the developing roll 43*b* and the seal roll SR (the rotational speeds of the developing roll 43*a*, the developing roll 43*b* and the seal roll SR and the driving time and driving interval of the seal roll SR) is controlled through a not-shown drive source by a CPU (an example of a control unit) 51.

The conveyance members 44*a* and 44*b* are members for conveying the dual-component developing agent to the developing rolls 43*a* and 43*b* while stirring and mixing the dual-component developing agent. The conveyance members 44*a* and 44*b* are rotatably disposed in opposite, left and right regions with interposition of a partition wall 42*c* in the developing agent reservoir portion 42*a* under the lower developing roll 43*a*, respectively. The conveyance members 44*a* and 44*b* are disposed side by side so that directions of their rotation shafts (perpendicular to the paper of FIG. 2) can run along the directions of the rotation shafts of the developing rolls 43*a* and 43*b* respectively.

For example, spiral rotary blades are formed in the outer circumferences of the rotation shafts of the conveyance members 44*a* and 44*b* so that the dual-component developing agents in the respective regions of the developing agent reservoir portion 42*a* can be conveyed in opposite directions to each other in the directions of the rotation shafts of the conveyance members 44*a* and 44*b*, respectively. Opening portions (not shown) are provided in the partition wall 42*c* on the opposite end sides in the directions of the rotation shafts of the conveyance members 44*a* and 44*b* so that the developing agents in the regions partitioned by the partition wall 42*c* can be delivered through the opening portions so as to circulate and move.

Of the two conveyance members 44*a* and 44*b*, the left conveyance member 44*b* on the downstream side of conveyance in FIG. 2 is disposed to be opposed to the lower developing roll 43*a* at a predetermined distance therefrom. The dual-component developing agent can be delivered from the conveyance member 44*b* to the lower developing roll 43*a* through the portion where the conveyance member 44*b* is opposed to the developing roll 43*a*. The dual-component developing agent is supplied into the developing agent reservoir portion 42*a* through a developing agent supply port (not shown) formed in an end portion of the developing agent reservoir portion 42*a*.

The layer thickness limiting member 45 is a plate-like member for limiting the layer thickness of the dual-component developing agent conveyed from the conveyance members 44*a* and 44*b* to the developing rolls 43*a* and 43*b*. The layer thickness (developing agent amount) of the dual-component developing agent delivered from the conveyance member 44*b* on the downstream side of conveyance to the lower developing roll 43*a* is limited by the layer thickness limiting member 45. After that, the dual-component developing agent is conveyed to the opposed portion (the developing nip portion N, the portion of the developing pole Z5*a*, Z3*b*) of each developing roll 43*a*, 43*b* to the photoconductor drum 220.

The layer thickness limiting member 45 is constituted by a plate-like member having a sectionally rectangular front end portion 45*a* and a sectionally rectangular rear end portion 45*b* formed continuously to the front end portion 45*a*. The layer thickness limiting member 45 is removably fixed just above the conveyance member 44*b* on the downstream side of conveyance and obliquely above the lower developing roll 43*a* by a bolt 48. In addition, the layer thickness limiting member 45 is disposed side by side with the lower developing roll 43*b* so that the longitudinal direction (perpendicular to the paper of FIG. 2) of the layer thickness limiting member 45 can run along the direction of the rotation shaft of the lower developing roll 43*b*.

The front end portion 45*a* of the layer thickness limiting member 45 is disposed to be opposed to the outer circumference of the lower developing roll 43*a* at a distance corresponding to a predetermined layer thickness value of the developing agent. The dual-component developing agent is formed into a thin layer while being frictionally charged due to magnetic interaction between the front end portion 45*a* of the layer thickness limiting member 45 and the magnet roll 43*aa* of the lower developing roll 43*a*. Thus, the dual-component developing agent can be retained on the surface of the sleeve 43*ab* of the lower developing roll 43*a*.

On the other hand, the rear end portion 45*b* of the layer thickness limiting member 45 is formed to be folded to cross the front end portion 45*a*. The rear end portion 45*b* is connected to a part of the conveyance guide 47 just above the layer thickness limiting member 45 through a joint member 49 having thermal conductivity. The rear end portion 45*b* has a function of making it easier to position the layer thickness limiting member 45 in the housing 420 and a function of increasing the contact area with the joint member 49 to thereby improve the heat radiation performance.

The rotary conveyor 46 is a member for sending the developing agent remaining on the upper developing roll 43*b* back into the developing agent reservoir portion 42*a*. The rotary conveyor 46 is disposed rotatably clockwise just above and between the conveyance members 44*a* and 44*b* and adjacently (on the right in FIG. 2) to the layer thickness limiting member 45. The rotary conveyor 46 is disposed so that the direction of its rotation shaft (perpendicular to the paper of FIG. 2) can run along the directions of the rotation shafts of the developing rolls 43*a* and 43*b* and the conveyance members 44*a* and 44*b*.

Four rotary blades 46*b* are formed on the outer circumference of a rotation shaft 46*a* of the rotary conveyor 46. Each rotary blade 46*b* is folded into an L-shape in section so as to hold the developing agent conveyed thereto. This is because the rotary conveyor 46 is rotated at a low speed to reserve the developing agent on the rotary conveyor 46 so that the volume of the reserved developing agent can be increased without increasing the size of the developing device 40.

The conveyance guide 47 is a member for forming a path through which the developing agent remaining on the upper developing roll 43*b* can be conveyed to the rotary conveyor 46 and sent back into the developing agent reservoir portion 42*a*. The conveyance guide 47 is formed out of a material having thermal conductivity, such as stainless steel, aluminum or copper, as the primary material.

The conveyance guide 47 is disposed between the upper developing roll 43*b* and the rotary conveyor 46 and just above the layer thickness limiting member 45 so as to be inclined downward from the upper developing roll 43*b* toward the rotary conveyor 46. The conveyance guide 47 is disposed so that its longitudinal direction (perpendicular to the paper of FIG. 2) can run along the directions of the rotation shafts of the developing roll 43*b* and the rotary conveyor 46. The developing agent remaining on the upper developing roll 43*b* after development migrates to the conveyance guide 47 due to the repulsive force in the separation pole Z6*b* of the magnet roll 43*ba* and the rotational centrifugal force of the developing roll 43*b*, and slides on the inclined surface as it is. Thus, the developing agent is sent to the rotary conveyor 46

The layer thickness limiting member 45 is disposed just under and adjacently to the conveyance guide 47, and the rear end portion 45*b* of the layer thickness limiting member 45 is connected to the conveyance guide 47 through the joint member 49 as described above. Thus, the layer thickness limiting member 45 located substantially at the center of the inside of the developing device 40 has the lowest heat radiation performance and may reach the highest temperature so that the heat of the layer thickness limiting member 45 can flow into the conveyance guide 47 through the joint member 49.

In addition, in the embodiment, as shown in FIG. 2, a suction duct 50 for sucking cloud toner, which is a flying developing agent which has not been used for development, is provided to be opened above the developing roll 43*b*.

The suction duct 50 is an upper duct for sucking the cloud toner generated by the developing rolls 43*a* and 43*b* in the opening portion 42*b* of the housing 420 due to negative pressure using a suction fan (not shown). The air in the suction duct 50 flows from the opening portion 42*b* toward the upper portion of the image forming apparatus 2 as shown by the arrows. The cloud toner sucked in the opening portion 42*b* is caught by a filter (not shown) on the way, so that only the clean air is discharged to the outside of the image forming apparatus 2.

For example, such a developing device 40 operates as follows.

The dual-component developing agent received in the developing agent reservoir portion 42*a* of the housing 420 is stirred and mixed by the conveyance members 44*a* and 44*b*, and supplied to the surface of the lower developing roll 43*a*. The dual-component developing agent adsorbed on the surface of the sleeve 43*ab* of the lower developing roll 43*a* due to the suction pole Z1*a* which is a magnetic pole portion provided in the magnet roll 43*aa* of the lower developing roll 43*a* is sent to the layer thickness limiting member 45 due to the rotation of the sleeve 43*ab*. The dual-component developing agent is limited in layer thickness (developing agent amount) and retained on the surface of the sleeve 43*ab* while being frictionally charged due to magnetic interaction between the layer thickness limiting member 45 and the magnet roll 43*aa* of the developing roll 43*a*.

The developing agent passing through the layer thickness limiting member 45 is formed into a thin layer, retained on the sleeve 43*ab* of the lower developing roll 43*a*, conveyed to the position opposed to the upper developing roll 43*b* and almost evenly divided into two, one of which is delivered onto the upper developing roll 43*b* due to the effect of the delivery pole Z3*a* of the developing roll 43*a* and the delivery pole Z1*b* of the developing roll 43*b* while the other is retained and conveyed on the sleeve 43*ab* of the lower developing roll 43*a*.

The developing agent retained on the sleeve 43*ab* of the lower developing roll 43*a* is conveyed to the portion (the developing nip portion N, the portion of the developing pole Z5*a*) opposed to the photoconductor drum 220. Toner of the developing agent is transferred to the electrostatic latent image of the photoconductor drum 220 due to the developing bias voltage applied between the lower developing roll 43*a* and the photoconductor drum 220.

On the other hand, the developing agent retained on the sleeve 43*bb* of the upper developing roll 43*b* is conveyed to the portion (the developing nip portion N, the portion of the developing pole Z3*b*) opposed to the photoconductor drum 220, due to the rotation of the sleeve 43*bb*. Toner of the developing agent is transferred to the electrostatic latent image of the photoconductor drum 220 due to the developing bias voltage applied between the upper developing roll 43*b* and the photoconductor drum 220.

The developing agent which has passed through the opposed portion to the photoconductor drum 220 but still remains on the sleeve 43*ab* of the lower developing roll 43*a* is separated due to the effect of the separation pole Z7*b* of the magnet roll 43*aa* of the lower developing roll 43*a* and its own weight. The separated developing agent is sent back into the developing agent reservoir portion 42*a*.

The developing agent which has passed through the opposed portion to the photoconductor drum 220 but still remains on the sleeve 43*bb* of the upper developing roll 43*b* is separated due to the effect of the separation pole Z6*b* of the magnet roll 43*ba* of the upper developing roll 43*b* and the centrifugal force of the sleeve 43*bb* of the developing roll 43*b*. The separated developing agent is delivered to the conveyance guide 47.

The developing agent delivered to the conveyance guide 47 after the developing process slides on the inclined surface of the conveyance guide 47 so as to be conveyed to the rotary conveyor 46. The developing agent delivered to the conveyance guide 47 is not sent directly back to the developing agent reservoir portion 42*a*, but is held temporarily on the rotary conveyor 46 while being sent back to the developing agent reservoir portion 42*a* to which the conveyance members 44*a* and 44*b* can give a stirring and mixing effect due to the rotations thereof. Then, the same operations as described above are repeated.

Figure 14:
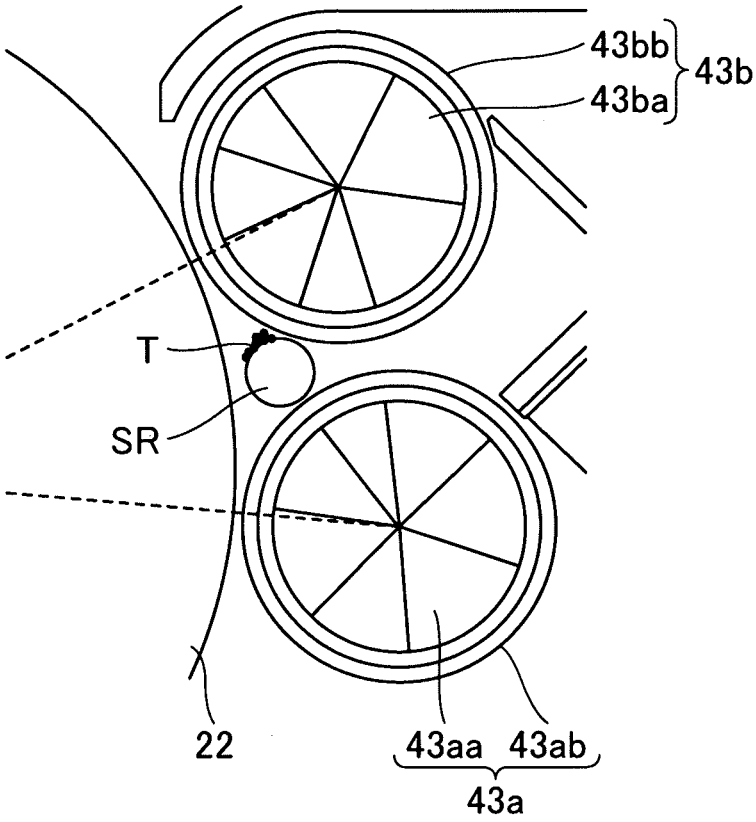
FIG. 14 is a view for explaining a developing agent deposited on the seal roll.
Figure 15:
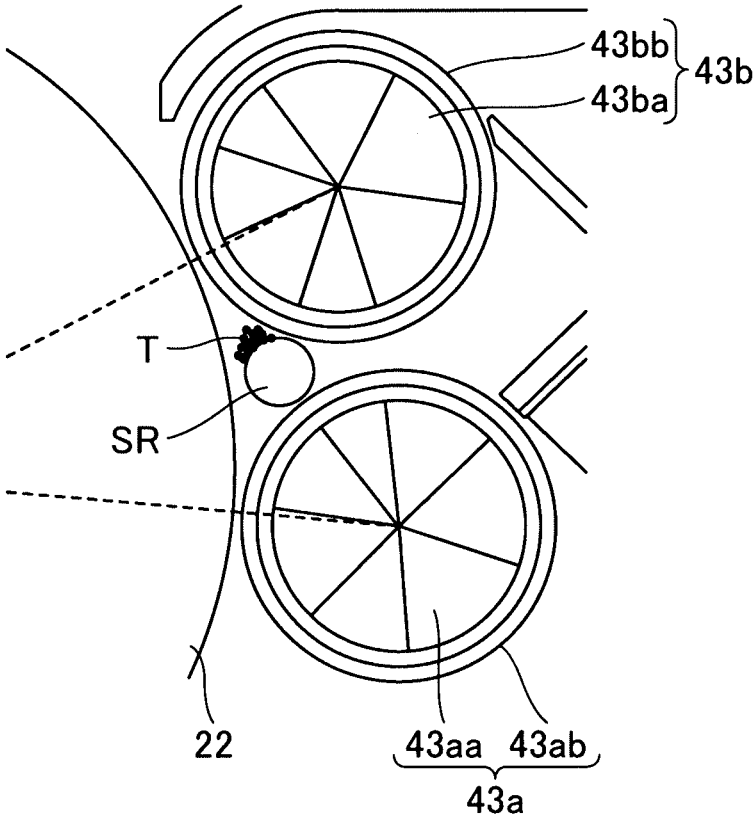
FIG. 15 is a view for explaining a state where the amount of the developing agent deposited on the seal roll increases.
Figure 16:
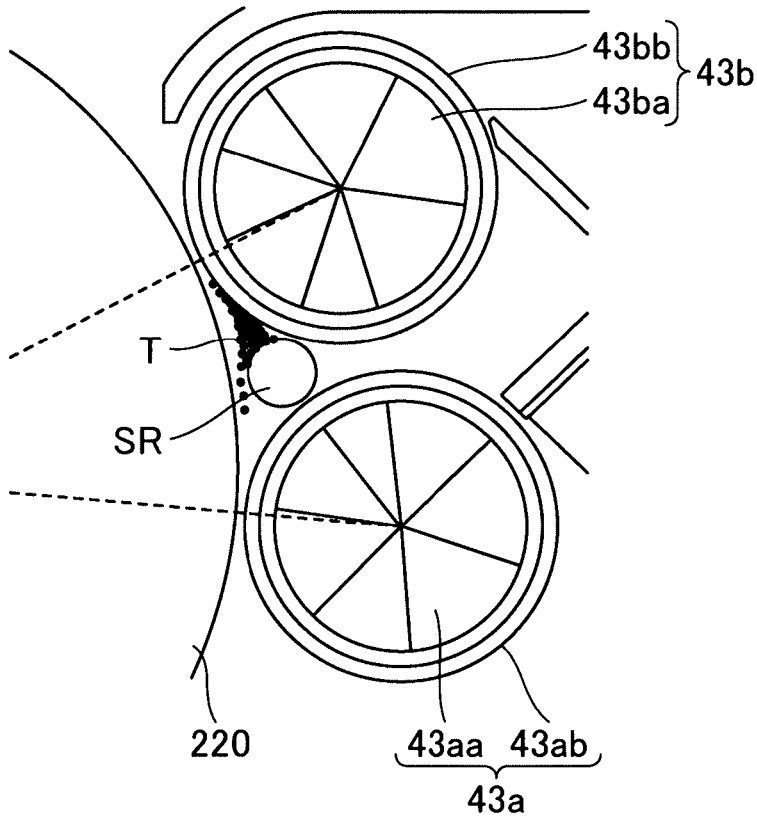
FIG. 16 is a view for explaining a state where the developing agent deposited on the seal roll has fallen down.

Here, as described previously, the developing agent on the seal roll SR is not recovered by the developing roll 43*b*. In addition, a suction force from the suction duct 50 using negative pressure is hardly exerted on the developing agent. Thus, a developing agent T is easily deposited on the seal roll S (see FIG. 14). When the developing agent T is deposited continuously on the seal roll S (see FIG. 15) and the deposited developing agent T falls down at last (see FIG. 16), the developing agent T adheres to the developing roll 43*b* located in the upper stage and reaches the developing nip portion N of the developing roll 43*b*. Thus, the developing agent T is transferred to the electrostatic latent image of the photoconductor drum 220. Alternatively, the developing agent T falls down due to its own weight and reaches the developing nip portion N of the developing roll 43*a* located in the lower stage. Thus, the developing agent T is transferred to the electrostatic latent image of the photoconductor drum 220.

When the developing agent deposited on the seal roll SR thus adheres to the photoconductor drum 220 during the formation of an image, good development cannot be performed but an image failure (image quality defect) occurs.

Therefore, in order to prevent such an image failure, the present inventor made a study on how to remove (clean) the developing agent deposited on the seal roll SR without adding any new mechanism to the developing device 40.

First, the rotational speed of the seal roll SR will be described with reference to FIG. 17. Here, FIG. 17 is a graph showing the relation between the number of rotations of the seal roll SR and the cleaning performance of the seal roll SR.

Figure 17:
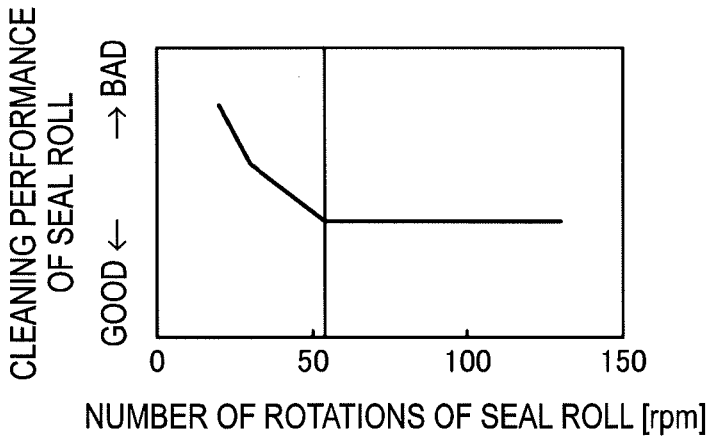
FIG. 17 is a graph showing the relation between the number of rotations of the seal roll and the cleaning performance of the seal roll.

As shown in FIG. 17, it is proved that the cleaning performance of the seal roll SR is good when the rotational speed of the seal roll SR is not lower than 54 rpm. Accordingly, the rotational speed of the seal roll SR is controlled to be not lower than 54 rpm by the CPU 51.

Next, the driving time of the seal roll SR will be described with reference to FIG. 18. Here, FIG. 18 is a graph showing the relation between the driving time of the seal roll SR and the amount of contamination on the seal roll SR.

Figure 18:
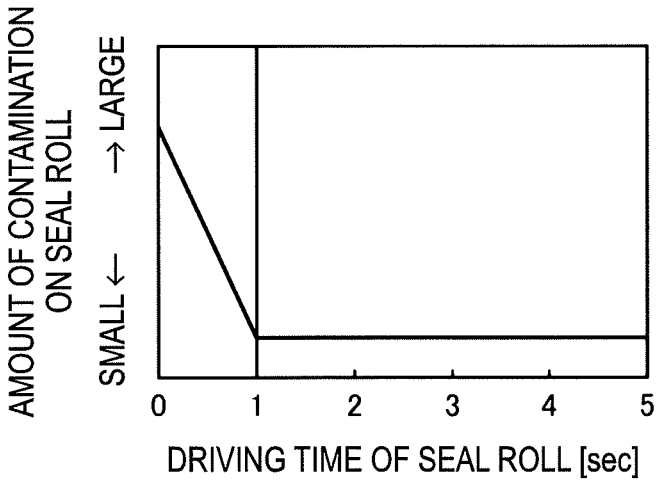
FIG. 18 is a graph showing the relation between the driving time of the seal roll and the amount of contamination on the seal roll.

As shown in FIG. 18, it is proved that the amount of contamination is reduced when the driving time of the seal roll SR is not shorter than 1 second. Accordingly, the driving time of the seal roll SR is controlled to be not shorter than 1 second by the CPU 51. The amount of contamination can be reduced by the driving time of 1 second, but it is desired that the driving time is about 4 seconds in consideration of the rising time since the rotation starts and till the rotation reaches its intended rotational speed (not lower than 54 rpm in this case).

The driving interval of the seal roll SR will be described with reference to FIG. 19. Here, FIG. 19 is a graph showing the relation between a print volume (the number of sheets with images recorded thereon) on a basis of A3-size paper and the amount of contamination on the seal roll SR.

Figure 19:
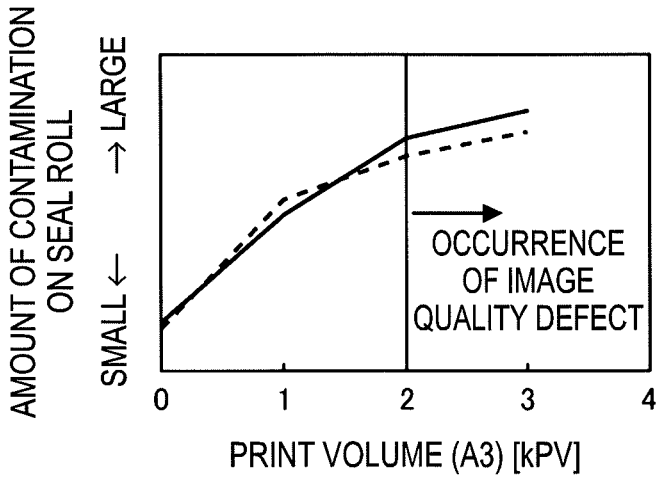
FIG. 19 is a graph showing the relation between a print volume (the number of sheets with images recorded thereon) on a basis of A3-size paper and the amount of contamination on the seal roll.

As shown in FIG. 19, the developing agent falls down to generate an image quality defect when the driving interval of the seal roll SR reaches 2,000 sheets of image formation on a basis of A3-size paper (an example of a recording medium) (4,000 sheets on a basis of A4-size paper which is half as large as A3-size paper). Here, in the embodiment, in consideration of a variation in the amount of contamination caused by the developing agent, it is assumed that an image quality defect occurs when the driving interval of the seal roll SR reaches 1,800 sheets of image formation on a basis of A3-size paper. Thus, by the CPU 51, the driving interval of the seal roll SR is controlled to be not longer than 1,800 sheets of image formation on the basis of A3-size paper.

The gap (distance) between the seal roll SR and each developing roll 43*a*, 43*b* and the amount of the developing agent per unit area on the sleeve 43*ab*, 43*bb* of the developing roll 43*a*, 43*b* will be described with reference to FIGS. 20 to 25.

Here, the seal roll SR is cleaned by friction with a magnetic brush on the sealing pole of the developing roll whose rotation direction is the same as the rotation direction of the seal roll SR. When the rotation direction of the seal roll SR is the first rotation direction as in the embodiment, the seal roll SR is cleaned by friction with a magnetic brush on the sealing pole Z4*a* of the developing roll 43*a* located in the lower stage. It is therefore desired that the gap between the seal roll SR and the developing roll is narrower in order to bring the magnetic brush into abutment against the seal roll SR to thereby clean the seal roll SR.

On the other hand, as to the developing roll (the developing roll 43*b* located in the upper stage when the rotation direction of the seal roll SR is the first rotation direction as in the embodiment) which does not contribute to cleaning, the cloud generated from the developing device 40 is prevented from escaping through the gap between the seal roll SR and the developing roll when the gap is narrowed. Thus, the cloud contaminates the seal roll SR. It is therefore desired that the gap between the seal roll SR and the developing roll is wider.

First, description will be made about the relation between the seal roll SR and the developing roll 43*a* located in the lower stage.

Figure 20:
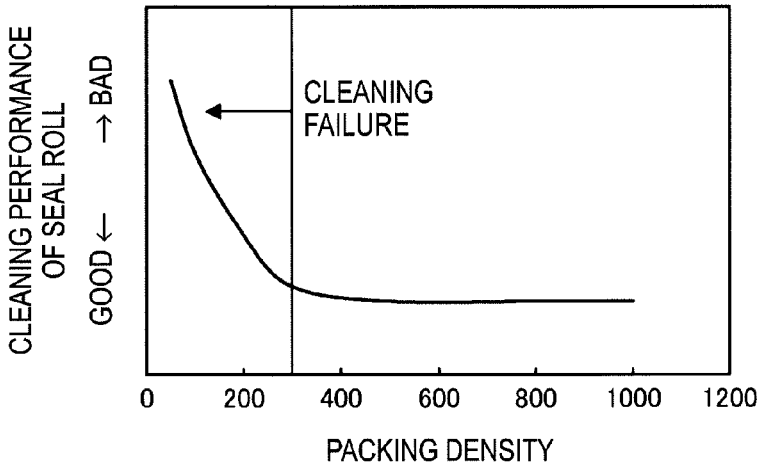
FIG. 20 is a graph showing the relation between the packing density in the developing roll located in the lower stage and the cleaning performance of the seal roll.
Figure 21:
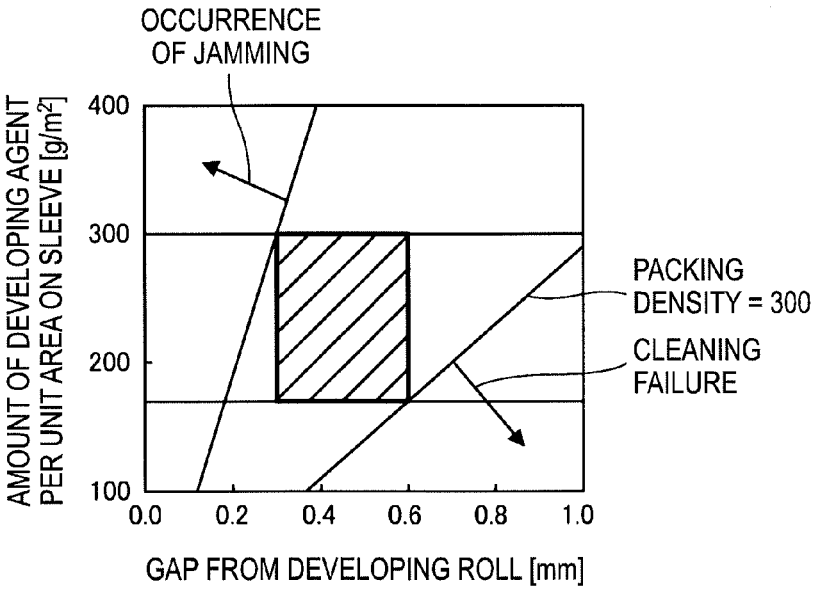
FIG. 21 is a graph showing the relation between the gap of the seal roll from the lower developing roll and the amount of the developing agent per unit area on a sleeve of the lower developing roll.
Figure 22:
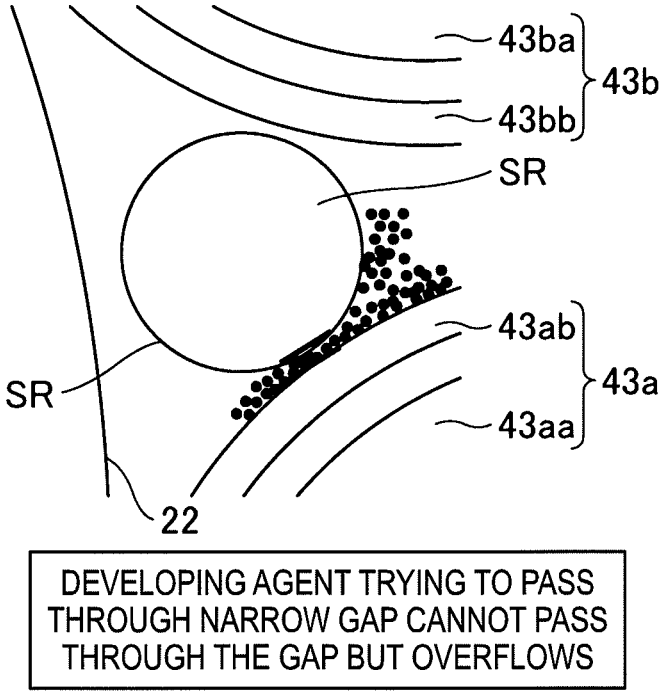
FIG. 22 is a view for explaining a state where jamming occurs between the seal roll and the lower developing roll.

Here, FIG. 20 is a graph showing the relation between the packing density and the cleaning performance of the seal roll SR. FIG. 21 is a graph showing the relation between the gap from the developing roll 43*a* (the gap between the seal roll SR and the developing roll 43*a*) and the amount of the developing agent per unit area on the sleeve 43*ab*. FIG. 22 is a view for explaining a state where jamming occurs between the seal roll SR and the developing roll 43*a*.

As shown in FIG. 20, when the packing density ((amount of developing agent per unit area on sleeve)/(gap from developing roll), which is (amount of developing agent per unit area on the sleeve 43*ab*)/(gap between the seal roll SR and the developing roll 43*a*) in this case) is lower than 300, the cleaning performance of the seal roll SR deteriorates to generate a cleaning failure. Therefore, in FIG. 21, the line in which the packing density is 300 is drawn. The region on the right of the line is a region where a cleaning failure occurs.

In addition, as shown in FIG. 22, when the gap between the seal roll SR and the developing roll 43*a* is reduced, the developing agent trying to pass through the narrow gap cannot pass through the gap but overflows to the inside of the developing device 40 (resulting in occurrence of jamming). The jamming uniquely depends on the gap between the seal roll SR and the developing roll 43*a* and the amount of the developing agent per unit area on the sleeve 43*ab*. In FIG. 21, a line corresponding to the boundary as to the occurrence of jamming is drawn. The region on the left of the line is a region where jamming occurs.

From the above description, in FIG. 21, a rectangular region obtained in a portion put between the line where the packing density is 300 and the line corresponding to the boundary as to the occurrence of jamming is a region where the relation between the gap from the developing roll 43*a* and the amount of the developing agent per unit area on the sleeve 43*ab* is good. A region where the rectangular shape approximates a square (the hatched region in FIG. 21) is a region where cleaning can be performed with a good balance between two factors (i.e. the gap from the developing roll 43*a* and the amount of the developing agent per unit area on the sleeve 43*ab*).

To define that region, it is preferable that the gap between the seal roll SR and the developing roll 43*a* (the lower gap shown in FIG. 3) is set at 0.45±0.15 mm (0.3 to 0.6 mm), and the amount of the developing agent on the sleeve 43*ab* is set at 170 to 300 g/m$^2$.

Next, description will be made about the relation between the seal roll SR and the developing roll 43*b* located in the upper stage.

Figure 23:
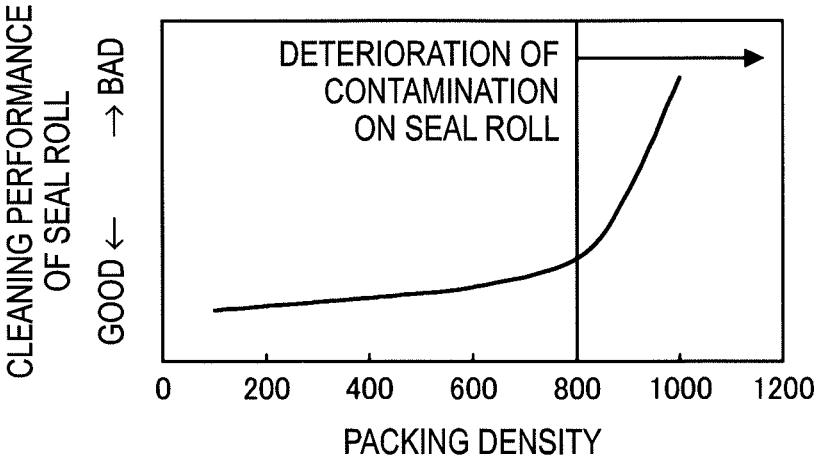
FIG. 23 is a graph showing the relation between the packing density in the developing roll located in the upper stage and the cleaning performance of the seal roll.
Figure 24:
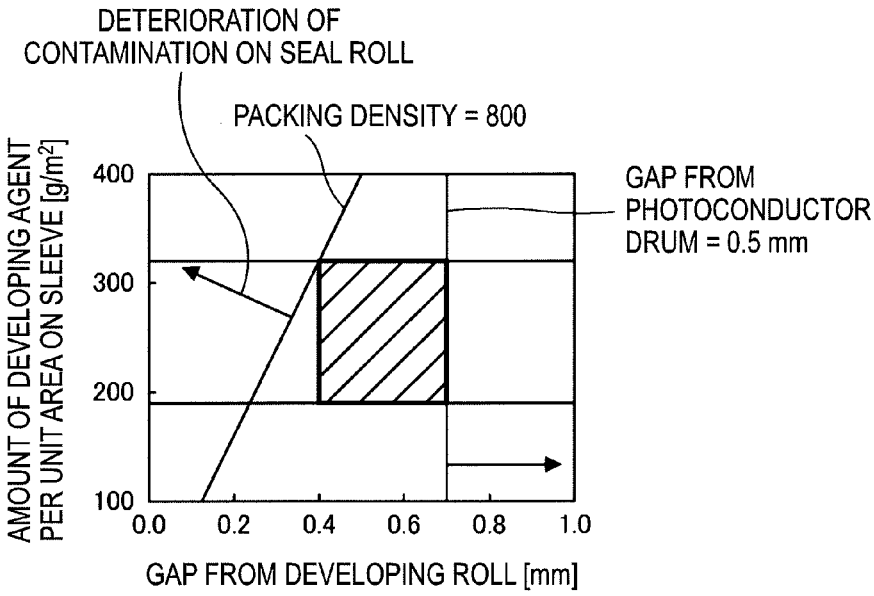
FIG. 24 is a graph showing the relation between the gap of the seal roll from the upper developing roll and the amount of the developing agent per unit area on a sleeve of the upper developing roll.
Figure 25:
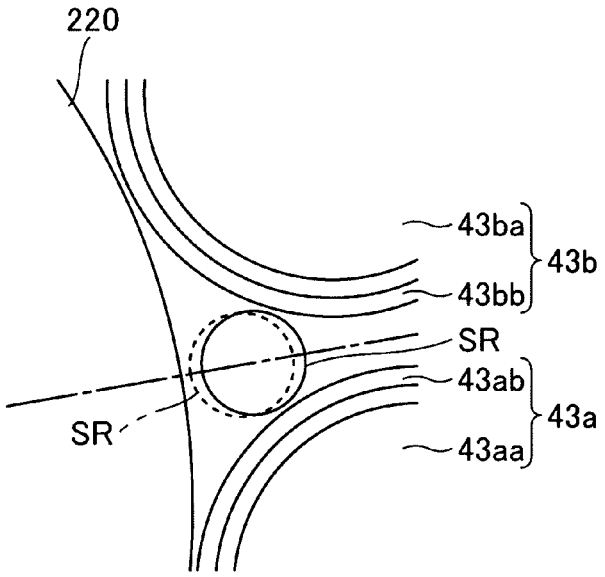
FIG. 25 is a view for explaining the distances among the seal roll, the upper developing roll and the photoconductor drum.

Here, FIG. 23 is a graph showing the relation between the packing density and the cleaning performance of the seal roll SR. FIG. 24 is a graph showing the relation between the gap from the developing roll 43*b* (the gap between the seal roll SR and the developing roll 43*b*) and the amount of the developing agent per unit area on the sleeve 43*bb*. FIG. 25 is a view for explaining the distances among the seal roll SR, the developing roll 43*b* and the photoconductor drum 220.

As shown in FIG. 23, when the packing density ((amount of developing agent per unit area on sleeve)/(gap from developing roll), which is (amount of developing agent per unit area on the sleeve 43*bb*)/(gap between the seal roll SR and the developing roll 43*b*) in this case) is higher than 800, the cleaning performance of the seal roll SR deteriorates to result in contamination of the seal roll SR. Therefore, in FIG. 24, the line in which the packing density is 800 is drawn. The region on the left of the line is a region where the seal roll SR is still contaminated even if the seal roll SR is cleaned.

In addition, as shown in FIG. 25, when the gap between the seal roll SR and the developing roll 43*b* is increased, the distance of the seal roll SR from the photoconductor drum 220 is reduced. Therefore, the distance between the seal roll SR and the photoconductor drum 220 is secured to be 0.5 mm or longer in order to avoid abutment of the seal roll SR against the photoconductor drum 220. In FIG. 24, a line where the distance from the photoconductor drum 220 is 0.5 mm is drawn. The region on the right of the line is a region where the distance from the photoconductor drum 220 is not longer than 0.5 mm.

From the above description, in FIG. 24, a rectangular region obtained in a portion put between the line where the packing density is 800 and the line where the distance from the photoconductor drum 220 is 0.5 mm is a region where the relation between the gap from the developing roll 43*b* and the amount of the developing agent per unit area on the sleeve 43*bb* is good. A region where the rectangular shape approximates a square (the hatched region in FIG. 24) is a region where cleaning can be performed with a good balance between two factors (i.e. the gap from the developing roll 43*b* and the amount of the developing agent per unit area on the sleeve 43*bb*).

To define that region, it is preferable that the gap between the seal roll SR and the developing roll 43*b* (the upper gap shown in FIG. 3) is set at 0.55±0.15 mm (0.4 to 0.7 mm), and the amount of the developing agent on the sleeve 43*bb* is set at 190 to 320 g/m$^2$.

As described previously, the rotation direction of the seal roll SR is the first rotation direction which is the same as the rotation direction of the sleeve 43*ab* of the lower developing roll 43*a* in the embodiment. When the rotation direction of the seal roll SR is the first rotation direction, the gap between the seal roll SR and the developing roll 43*a* is 0.45±0.15 mm (0.3 to 0.6 mm), and the gap between the seal roll SR and the developing roll 43*b is* 0.55±10.15 mm (0.4 to 0.7 mm).

On the other hand, when the rotation direction of the seal roll SR is the second rotation direction, those numerical values are replaced by each other. That is, the gap between the seal roll SR and the developing roll 43*a* is 0.55±10.15 mm (0.4 to 0.7 mm), and the gap between the seal roll SR and the developing roll 43*b* is 0.45±10.15 mm (0.3 to 0.6 mm).

The magnetic flux densities in the sealing poles Z4*a* and Z2*b* of the developing rolls 43*a* and 43*b* will be described with reference to FIG. 26. Here, FIG. 26 is a graph showing the relation between the magnetic flux density of the sealing pole Z4*a* of the lower developing roll 43*a* and the cleaning performance of the seal roll SR.

Figure 26:
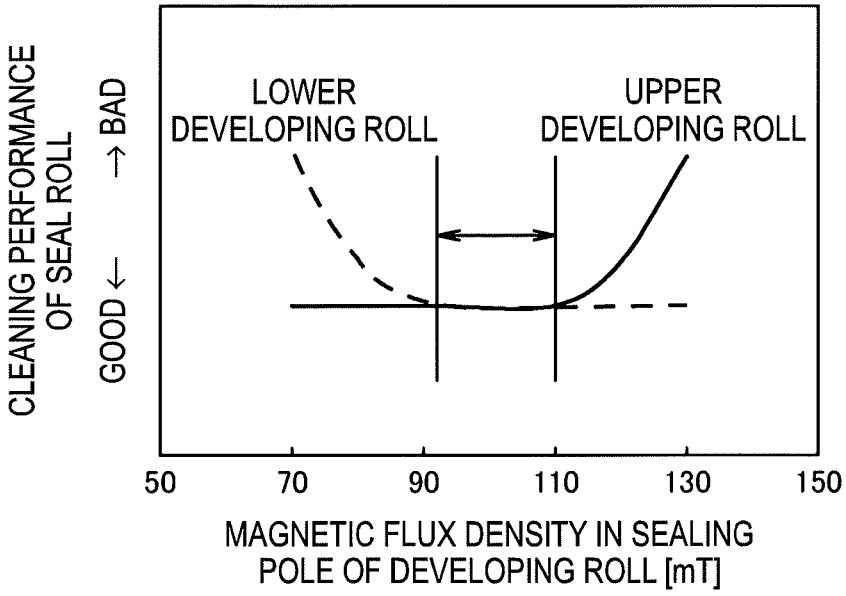
FIG. 26 is a graph showing the relation between the magnetic flux density of a sealing pole of the lower developing roll and the cleaning performance of the seal roll.

As shown in FIG. 26, when the rotation direction of the seal roll SR is the first rotation direction, the magnetic brush is developed so that the cleaning performance can be increased if the magnetic flux density of the sealing pole Z4*a* of the lower developing roll 43*a* which is the developing roll engaging in cleaning is higher. However, when the magnetic flux density of the sealing pole Z2*b* of the upper developing roll 43*b* which is the developing roll not contributing to cleaning is increased, the seal roll SR is contaminated.

When the magnetic flux density of the sealing pole Z4*a* of the lower developing roll 43*a* and the magnetic flux density of the sealing pole Z2*b* of the upper developing roll 43*b* are in a range of from 92 to 110 mT, the cleaning performance of the seal roll SR becomes good.

FIG. 26 shows the case where the rotation direction of the seal roll SR is the first rotation direction. When the rotation direction of the seal roll SR is the second rotation direction, the developing roll engaging in cleaning is the upper developing roll 43*b*, while the developing roll not contributing to cleaning is the lower developing roll 43*a*. Thus, the curve of the developing roll 43*a* and the curve of the developing roll 43*b* in FIG. 26 are replaced by each other.

Accordingly, also in this case, when the magnetic flux density of the sealing pole Z4*a* of the lower developing roll 43*a* and the magnetic flux density of the sealing pole Z2*b* of the upper developing roll 43*b* are in a range of from 92 to 110 mT, the cleaning performance of the seal roll SR becomes good.

It is therefore preferable that the magnetic flux density of the sealing pole Z4*a* of the developing roll 43*a* and the magnetic flux density of the sealing pole Z2*b* of the developing roll 43*b* are set in a range of from 92 to 110 mT no matter which rotation direction (the first rotation direction or the second rotation direction) the seal roll SR rotates in.

Figure 27:
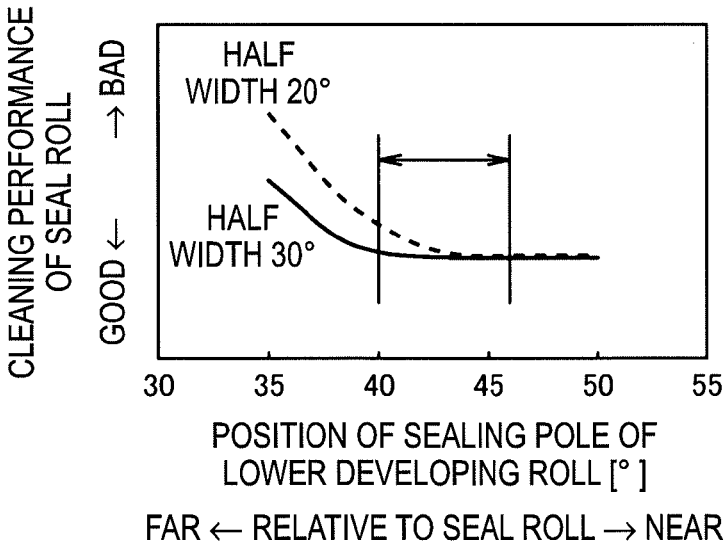
FIG. 27 is a graph showing the relation between the position of the sealing pole of the lower developing roll and the cleaning performance of the seal roll when the half width of the sealing pole is 20° or 30'.
Figure 28:
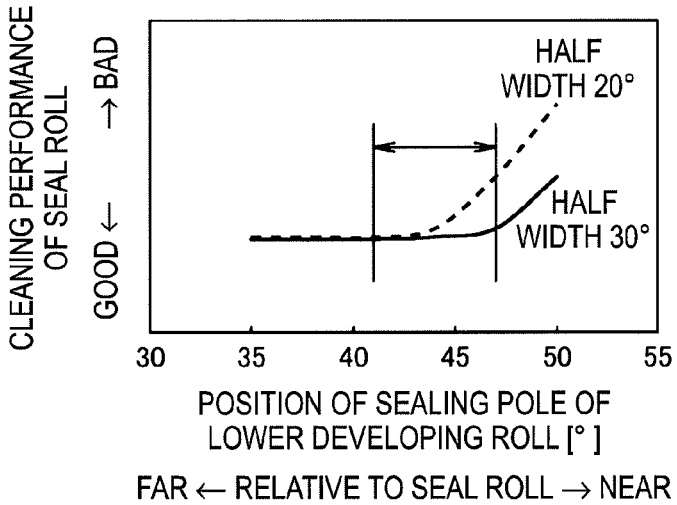
FIG. 28 is a graph showing the relation between the position of a sealing pole of the upper developing roll and the cleaning performance of the seal roll when the half width of the sealing pole is 20° or 30°.
Figure 29:
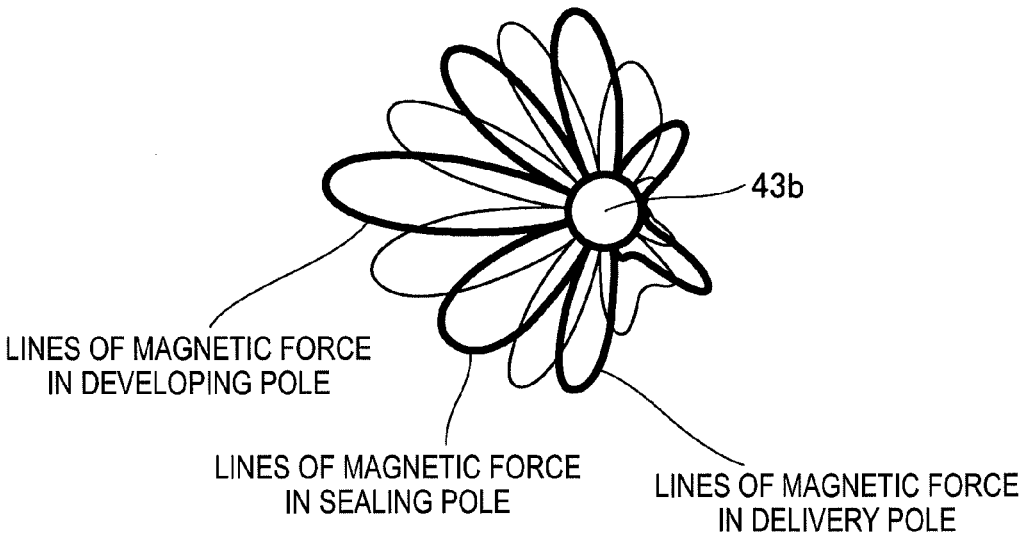
FIG. 29 is an explanatory view showing lines of magnetic force in the upper developing roll.
Figure 30:
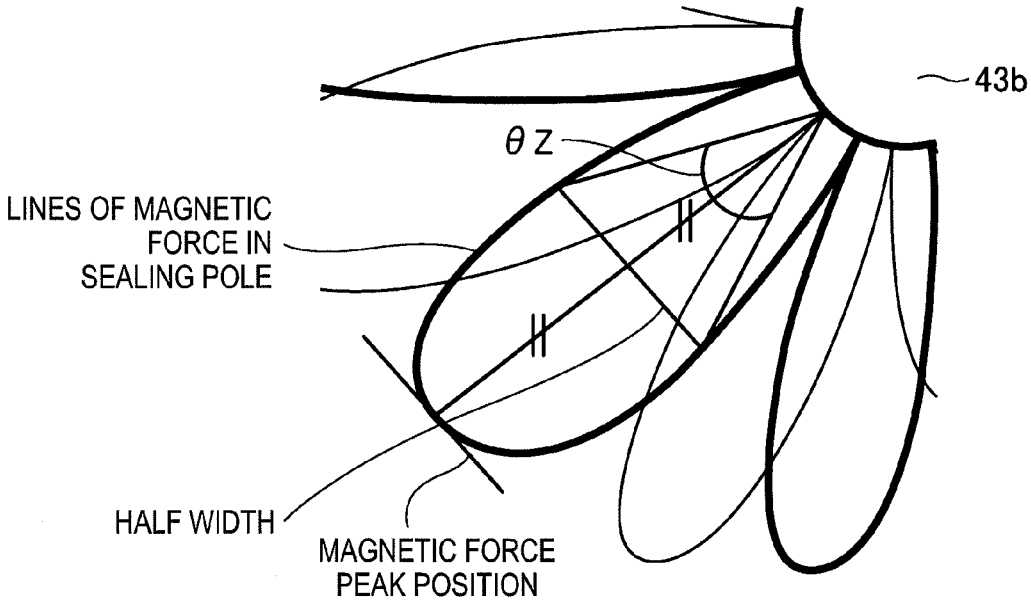
FIG. 30 is an enlarged explanatory view showing the lines of magnetic force in the sealing pole of the upper developing roll.

The positions and half widths of the sealing poles Z4*a* and Z2*b* of the developing rolls 43*a* and 43*b* will be described with reference to FIGS. 27 to 30. Here, FIG. 27 is a graph showing the relation between the position of the sealing pole Z4*a* of the lower developing roll 43*a* and the cleaning performance of the seal roll SR when the half width of the sealing pole Z4*a* is 20° or 30°. FIG. 28 is a graph showing the relation between the position of the sealing pole Z2*b* of the upper developing roll 43*b* and the cleaning performance of the seal roll SR when the half width of the sealing pole Z2*b* is 20° or 30°. FIG. 29 is an explanatory view showing lines of magnetic force in the upper developing roll 43*b*. FIG. 30 is an enlarged explanatory view showing the lines of magnetic force in the sealing pole Z2*b* of the upper developing roll 43*b*.

As shown in FIG. 27, when the rotation direction of the seal roll SR is the first rotation direction, it is desirable that the sealing pole Z4*a* of the lower developing roll 43*a* which is the developing roll engaging in cleaning is disposed in a position (proximate portion) where the developing roll 43*a* and the seal roll SR are the closest to each other, in order to bring the magnetic brush into stronger abutment against the seal roll SR. On the other hand, as shown in FIG. 28, it is proved that it is desirable that the sealing pole Z2*b* of the upper developing roll 43*b* which is the developing roll not contributing to cleaning is disposed out of a proximate portion between the developing roll 43*b* and the seal roll SR so that the magnetic brush can be placed out of the seal roll SR to reduce the amount of contamination on the surface of the seal roll SR.

The cleaning performance of the seal roll SR becomes good when an angle (an angle θ1 in FIG. 3) between a line L1 (FIG. 3) connecting the center point of the photoconductor drum 220 with the center point of the developing roll 43*a* located in the lower stage and the sealing pole Z4*a* of the developing roll 43*a* is set at 43±3°, and an angle (an angle θ2 in FIG. 3) between a line L2 (FIG. 3) connecting the center point of the photoconductor drum 220 with the center point of the developing roll 43*b* located in the upper stage and the sealing pole Z2*b* of the developing roll 43*b* is set at 44±3°.

Here, the half widths will be described. For example, when the lines of magnetic force in the upper developing roll 43*b* run as shown in FIG. 29, the lines of magnetic force in the sealing pole Z2*b* can be drawn in enlarged view as shown in FIG. 30. The half width in FIG. 30 designates a magnetic force width θz which is half as high as the magnetic force peak in the lines of magnetic force in the sealing pole Z2*b*.

As shown in FIGS. 27 and 28, when the half widths are increased, the sensitivity of the cleaning performance is lowered in response to the rotational displacements of magnetic patterns of the developing rolls 43*a* and 43*b*. It is therefore desirable that the half widths are broader. In the illustrated case, the half widths of the sealing poles Z4*a* and Z2*b* are preferably not narrower than 30° in both the developing roll 43*a* located in the lower stage and the developing roll 43*b* located in the upper stage.

FIGS. 27 and 28 show the case where the rotation direction of the seal roll SR is the first rotation direction. When the rotation direction of the seal roll SR is the second rotation direction, the developing roll engaging in cleaning is the upper developing roll 43*b*, while the developing roll not contributing to cleaning is the lower developing roll 43*a*. Thus, the curve of the developing roll 43*a* and the curve of the developing roll 43*b* in FIGS. 27 and 28 are replaced by each other.

Accordingly, also in this case, the cleaning performance of the seal roll SR becomes good when the angle (the angle θ1 in FIG. 3) between the line L1 (FIG. 3) connecting the center point of the photoconductor drum 220 with the center point of the developing roll 43*a* located in the lower stage and the sealing pole Z4*a* of the developing roll 43*a* is set at 43±3°, and the angle (the angle θ2 in FIG. 3) between the line L2 (FIG. 3) connecting the center point of the photoconductor drum 220 with the center point of the developing roll 43*b* located in the upper stage and the sealing pole Z2*b* of the developing roll 43*b* is set at 44±3°.

Accordingly, no matter which rotation direction (the first rotation direction or the second rotation direction) the seal roll SR rotates in, the cleaning performance of the seal roll SR becomes good when the angle (the angle θ1 in FIG. 3) between the line L1 (FIG. 3) connecting the center point of the photoconductor drum 220 with the center point of the developing roll 43*a* located in the lower stage and the sealing pole Z4*a* of the developing roll 43*a* is set at 43±3°, and the angle (the angle θ2 in FIG. 3) between the line L2 (FIG. 3) connecting the center point of the photoconductor drum 220 with the center point of the developing roll 43*b* located in the upper stage and the sealing pole Z2*b* of the developing roll 43*b* is set at 44±3°.

Here, the developing device according to the invention does not have to include all the numerical conditions explained in FIGS. 17 to 30.

That is, in the developing device according to the invention, it will go well at least if the gap between the seal roll SR and the developing roll 43*a* located in the lower stage is 0.45±0.15 mm and the gap between the seal roll SR and the developing roll 43*b* located in the upper stage is 0.55±10.15 mm when the seal roll SR rotates in the first rotation direction, the seal roll SR and the developing roll 43*a* is 0.55±0.15 mm and the gap between the seal roll SR and the developing roll 43*b* is 0.45±0.15 mm when the seal roll SR rotates in the second rotation direction, and the CPU 51 controls the rotational speed of the seal roll SR to be not lower than 54 rpm (first conditions).

Thus, the developing agent deposited on the seal roll SR can be removed.

In addition to the first conditions, the developing device according to the invention may be arranged so that the CPU 51 controls the driving time of the seal roll SR to be not shorter than 1 second and controls the driving interval of the seal roll SR to be not larger than 1,800 sheets of image formation on a basis of A3-size paper (second conditions).

Thus, the time and interval of removing the developing agent deposited on the seal roll SR are optimized so that the removal efficiency can be improved.

Further, in addition to the first or second conditions, the developing device according to the invention may be arranged so that the amount of the developing agent on the sleeve 43*ab* of the developing roll 43*a* located in the lower stage is 170 to 300 g/m$^2$, the amount of the developing agent on the sleeve 43*bb* of the developing roll 43*b* located in the upper stage is 190 to 320 g/m$^2$, the angle between the line L1 connecting the center point of the photoconductor drum 220 with the center point of the developing roll 43*a* and the sealing pole Z4*a* of the developing roll 43*a* is 43±3°, the angle between the line L2 connecting the center point of the photoconductor drum 220 with the center point of the developing roll 43*b* and the sealing pole Z2*b* of the developing roll 43*b* is 44±3°, the half widths of the sealing poles Z4*a* and Z2*b* are not narrower than 30°, and the magnetic flux densities of the sealing poles Z4*a* and Z2*b* are 92 to 110 mT (third conditions).

Thus, the developing agent deposited on the seal roll SR can be removed more surely.

According to the image forming apparatus using such a developing device, the developing agent deposited on the seal roll SR can be prevented from falling down and adhering to the photoconductor drum 220 during image formation. Thus, good development can be performed.

The invention made by the inventor has been described above specifically along its embodiment. The embodiment disclosed herein is an exemplification in all respects. It should be noted that the invention is not limited to the disclosed technique. That is, the technical scope of the invention is not interpreted restrictively based on the description of the embodiment but should be interpreted in accordance with the description of the claims. All techniques equivalent to techniques stated in the claims and all changes made without departing from the essential points of the claims are included in the invention.

For example, the embodiment has been described in the case where the embodiment is applied to an image forming apparatus of a direct transfer system in which a toner image of a photoconductor drum is transferred directly to a sheet of paper. However, the invention is not limited thereto but may be applied to an image forming apparatus of a secondary transfer system in which a toner image transferred to an intermediate transfer belt is transferred to a sheet of paper.

Other Exemplary Embodiments

In addition, the first exemplary embodiment and the second exemplary embodiment have been described in the case where paper is used as a recording medium. However, the invention is not limited thereto but may be applied to various media where an image can be formed, such as film, postcard, etc.

Description has been made above in the case where the invention is applied to a color printer. However, another image forming apparatus for recording a monochrome image may be used. And, for example, the invention may be applied to another image forming apparatus such as a color copying machine, a facsimile machine or an image forming apparatus having a combination of these functions.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A developing device comprising:

a first developing body that is disposed in a device body and develops a developing agent image on a development surface using a developing agent;

a second developing body that is disposed in an upper stage of the first developing body in the device body and develops a developing agent image on the development surface using the developing agent;

a first developing pole that is formed as a magnetic pole for performing development in the first developing body;

a first delivery pole that is formed in a position opposed to the second developing body in the first developing body and formed as a magnetic pole for performing delivery of the developing agent between the first developing body and the second developing body;

a first conveyance pole that is formed between the first developing pole and the first delivery pole in the first developing body and formed as a magnetic pole for conveying the developing agent from the first delivery pole to the first developing pole;

a second developing pole that is formed as a magnetic pole for performing development in the second developing body;

a second delivery pole that is formed in a position opposed to the first developing body in the second developing body and formed as a magnetic pole for performing delivery of the developing agent between the first developing body and the second developing body;

a second conveyance pole that is formed between the second developing pole and the second delivery pole in the second developing body and formed as a magnetic pole for conveying the developing agent from the second delivery pole to the second developing pole; and a sealing member that is disposed between a region where the first delivery pole and the second delivery pole are opposed to each other and the development surface, and adjacently to the first developing body and the second developing body at distances so small that developing agents formed as magnetic brushes on the first conveyance pole and the second conveyance pole touch the sealing member.

2. The developing device according to claim 1, further comprising:

a power supply unit that applies electric potential to the sealing member to attach, to the sealing member, the developing agent appearing between each of the first developing pole and the second developing pole and the development surface.

3. The developing device according to claim 1, wherein:

the sealing member is provided rotatably so that the developing agent adhering to the sealing member can be recovered by the developing agents formed as magnetic brushes on the first conveyance pole and the second conveyance pole respectively.

4. The developing device according to claim 1, wherein:

the sealing member has a function of limiting a layer thickness of the developing agent conveyed from each of the first conveyance pole and the second conveyance pole to each of the first developing pole and the second developing pole.

5. The developing device according to claim 1, further comprising:

a support member that supports one axial end sides of the sealing member, the first developing body and the second developing body in the device body while keeping the distance between each of the first developing body and the second developing body and the sealing member; and a positioning unit that supports other axial end sides of the sealing member, the first developing body and the second developing body while keeping the distance between each of the first developing body and the second developing body and the sealing member, and is supported in the device body rotatably forward and backward around a support portion on the other axial end of the first developing body so that a relative position between the second developing body and the development surface can be determined by the forward and backward rotational operation.

6. The developing device according to claim 1, further comprising:

a control unit that makes control to rotate the first developing body, the second developing body and the sealing member so as to remove the developing agent deposited on the sealing member, wherein:

the first developing body is provided to be opposed to an image retainer retaining an electrostatic latent image, and rotated in a first rotation direction the same as a rotation direction of the image retainer in a portion where the first developing body is opposed to the image retainer, so as to supply a developing agent to the electrostatic latent image to develop a toner image as the developing agent image;

the second developing body is opposed to the image retainer, and rotated in a second rotation direction opposite to the rotation direction of the image retainer in a portion where the second developing body is opposed to the image retainer, so as to supply the developing agent to the electrostatic latent image to develop a toner image as the developing agent image;

the sealing member is rotatably provided between the first developing body and the second developing body;

a distance between the sealing member and the first developing body is 0.45±0.15 mm and a distance between the sealing member and the second developing body is 0.55±0.15 mm when the sealing member is rotated in the first rotation direction;

the distance between the sealing member and the first developing body is 0.55±0.15 mm and the distance between the sealing member and the second developing body is 0.45±0.15 mm when the sealing member is rotated in the second rotation direction; and the control unit controls a rotational speed of the sealing member to be not lower than 54 rpm.

7. The developing device according to claim 6, wherein:

the control unit controls a driving time of the sealing member to be not shorter than 1 second; and the control unit controls a driving interval of the sealing member to be not larger than 1,800 sheets of image formation on a basis of A3-size recording media.

8. The developing device according to claim 6, wherein:

the first developing body includes:

a first rotary member that is rotatably provided outer-circumferentially; and a first magnetic pole forming body that is provided inside the first rotary member and includes the first developing pole, the first delivery pole and the first conveyance pole;

the second developing body includes:

a second rotary member that is rotatably provided outer-circumferentially; and a second magnetic pole forming body that is provided inside the second rotary member and includes the second developing pole, the second delivery pole and the second conveyance pole;

an amount of the developing agent on the first rotary member of the first developing body is 170 to 300 $g/m^2$;

an amount of the developing agent of the second rotary member of the second developing body is 190 to 320 $g/m^2$;

an angle between a line connecting a center point of the image retainer with a center point of the first developing body and the first conveyance pole is 43±3°;

an angle between a line connecting the center point of the image retainer with a center point of the second developing body and the second conveyance pole is 44±3°;

a half width of the first conveyance pole of the first developing body is not narrower than 30°;

a half width of the second conveyance pole of the second developing body is not narrower than 30°;

a magnetic flux density of the first conveyance pole of the first developing body is 92 to 110 mT; and a magnetic flux density of the second conveyance pole of the second developing body is 92 to 110 mT.

9. An image forming apparatus, comprising:

the image retainer that retains the electrostatic latent image;

a developing device according to claim 6, which is provided to be opposed to the image retainer so as to supply the developing agent to the electrostatic latent image of the image retainer to develop the toner image; and a transfer unit that is provided to be opposed to the image retainer so as to transfer the toner image developed on the image retainer to a transfer medium.

10. An image forming apparatus comprising:

an image retainer that retains an electrostatic latent image;

a developing device according to claim 1, that is provided to be opposed to the image retainer so as to attach the developing agent to the electrostatic latent image of the image retainer to develop the developing agent image; and a transfer unit that is provided to be opposed to the image retainer so that the developing agent image developed on the image retainer can be transferred to a transfer medium.

* * * * *